US012071291B2

(12) United States Patent
Ford

(10) Patent No.: US 12,071,291 B2
(45) Date of Patent: Aug. 27, 2024

(54) CARRIER FOR CONTAINERS

(71) Applicant: Graphic Packaging International, LLC, Atlanta, GA (US)

(72) Inventor: Colin P. Ford, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/848,682

(22) Filed: Jun. 24, 2022

(65) Prior Publication Data

US 2022/0411156 A1 Dec. 29, 2022

Related U.S. Application Data

(60) Provisional application No. 63/219,896, filed on Jul. 9, 2021, provisional application No. 63/214,868, filed on Jun. 25, 2021.

(51) Int. Cl.
*B65D 71/50* (2006.01)

(52) U.S. Cl.
CPC ..... *B65D 71/50* (2013.01)

(58) Field of Classification Search
CPC ..... B65D 71/50; B65D 71/40
USPC ..... 206/145, 147, 148, 158, 427
See application file for complete search history.

(56) References Cited

U.S. PATENT DOCUMENTS

| | | | |
|---|---|---|---|
| 1,527,399 | A | 2/1925 | Davidson |
| 2,289,859 | A | 7/1942 | Arthur |
| 2,320,440 | A | 6/1943 | Kruea |
| 2,331,038 | A | 10/1943 | Meller |
| 2,397,376 | A | 3/1946 | Caldwell |
| 2,397,716 | A | 4/1946 | Wendler |
| 2,522,950 | A | 9/1950 | Keith |
| 2,594,376 | A | 4/1952 | Arneson |
| 2,594,377 | A | 4/1952 | Arneson |
| 2,737,326 | A | 3/1956 | Toensmeier |

(Continued)

FOREIGN PATENT DOCUMENTS

| | | |
|---|---|---|
| AT | 399701 B | 7/1995 |
| CA | 2133827 | 10/1993 |

(Continued)

OTHER PUBLICATIONS

"Florida brewery unveils six-pack rings that spare sea turtles, not snare them," by Thomas Leavy, CBSNews.com. Date posted: May 24, 2018. Site visited: Sep. 12, 2022. Available online: https://www.cbsnews.com/news/ florida-saltwater-brewery-non-plastic-six-pack-rings-spare-sea-turtles/ (Year: 2018).

(Continued)

*Primary Examiner* — Steven A. Reynolds
(74) *Attorney, Agent, or Firm* — Womble Bond Dickinson (US) LLP

(57) ABSTRACT

A carrier for holding a plurality of containers includes an attachment panel having a plurality of container retention openings for at least partially receiving respective containers of the plurality of containers, and container retention features including the plurality of container retention openings and at least one container retention tab in at least partial face-to-face contact with the attachment panel and for being positioned between adjacent containers of the plurality of containers to urge the plurality of containers into engagement with the attachment panel.

23 Claims, 13 Drawing Sheets

(56) References Cited

U.S. PATENT DOCUMENTS 2,798,603 A 7/1957 Grinspoon
2,814,385 A 11/1957 Stone
2,950,041 A 8/1960 Stone
2,965,410 A 12/1960 Hughes
3,001,647 A 9/1961 Liss
3,005,654 A 10/1961 Stone et al.
3,046,711 A 7/1962 Harrison
3,061,141 A 10/1962 Cote
3,094,210 A 6/1963 Van Der Berg
3,099,475 A 7/1963 Manizza
3,118,537 A 1/1964 Copping
3,128,034 A 4/1964 Weiss
3,137,109 A 6/1964 Rapata
3,146,885 A 9/1964 Grantham
3,156,358 A 11/1964 Randrup
3,200,944 A 8/1965 Rapata
3,223,308 A 12/1965 Weiss
3,245,711 A 4/1966 Dantoin
3,257,066 A 6/1966 Williams
3,281,180 A 10/1966 Spery
3,302,784 A 2/1967 Copping
3,387,879 A 6/1968 Wood
3,404,912 A 10/1968 Watts
3,410,596 A 11/1968 Slevin, Jr.
3,432,202 A 3/1969 Ebelhardt
3,463,535 A 8/1969 Beart
3,528,697 A 9/1970 Wood
3,587,847 A 6/1971 Graser
3,601,439 A 8/1971 Poupitch
3,612,266 A 10/1971 Graser
D222,579 S 11/1971 Oglesbee
3,627,121 A 12/1971 Deasy
3,653,503 A 4/1972 Arneson
3,693,787 A 9/1972 Duerr
3,698,550 A 10/1972 Graser
3,701,416 A 10/1972 Lawrence
3,722,945 A * 3/1973 Wood ..... B65D 71/46 294/87.2
3,726,558 A 4/1973 Klygis
3,734,278 A 5/1973 Kerrigan
3,767,041 A * 10/1973 Graser ..... B65D 71/48 206/148
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,078,357 A 3/1978 Ida
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
4,192,540 A * 3/1980 Oliff ..... B65D 71/46 206/161
D257,001 S 9/1980 Oliff
4,244,617 A 1/1981 Manizza
4,304,329 A 12/1981 Graser
D265,292 S 7/1982 Killy
4,339,032 A 7/1982 Wood
D265,979 S 8/1982 Arfert
4,372,599 A 2/1983 Kiedaisch et al.
4,378,879 A 4/1983 Killy
4,382,505 A 5/1983 Sutherland et al.
4,441,611 A 4/1984 Sommariva
4,453,630 A 6/1984 Helms
4,471,870 A 9/1984 Uhlig
4,523,676 A 6/1985 Barrash
4,566,591 A * 1/1986 Turtschan ..... B65D 71/42 206/427
4,703,847 A * 11/1987 Oliff ..... B65D 71/16 206/160
D294,331 S 2/1988 Panazzolo
4,736,977 A 4/1988 Killy
4,784,266 A 11/1988 Chaussadas
D304,017 S 10/1989 Oliff
4,911,288 A 3/1990 Dantoin, Jr.
4,974,726 A 12/1990 Klygis et al.
5,002,225 A 3/1991 Bienaime
5,065,862 A 11/1991 Mousseau
5,103,971 A 4/1992 Schuster
5,125,506 A 6/1992 Galbierz et al.
5,135,104 A 8/1992 Jorba
5,139,147 A 8/1992 Sutherland
D329,807 S 9/1992 Heider
5,188,225 A 2/1993 Jorba
5,193,673 A 3/1993 Rathbone et al.
5,201,412 A 4/1993 Schuster et al.
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,446 A 6/1995 Weaver
5,443,153 A 8/1995 Sutherland
5,445,262 A 8/1995 Sutherland
5,452,799 A 9/1995 Sutherland
5,469,687 A 11/1995 Olson
5,484,053 A 1/1996 Harris
5,485,914 A 1/1996 Martin
5,487,464 A 1/1996 Galbierz et al.
5,490,593 A 2/1996 Gordon et al.
5,503,267 A 4/1996 Sutherland
5,520,283 A 5/1996 Sutherland
5,524,756 A 6/1996 Sutherland
5,542,536 A 8/1996 Sutherland
5,551,566 A 9/1996 Sutherland
5,553,704 A 9/1996 Gordon et al.
5,553,705 A 9/1996 Bakx
5,573,111 A 11/1996 Gordon
5,590,776 A 1/1997 Galbierz
5,593,027 A 1/1997 Sutherland
5,609,247 A 3/1997 Appleton
5,609,251 A 3/1997 Harris
5,609,379 A 3/1997 Harrelson
5,639,137 A 6/1997 Bakx
5,682,982 A 11/1997 Stonehouse
5,706,936 A 1/1998 Bernstein
5,711,419 A * 1/1998 Beales ..... B65D 71/40 206/148
5,735,394 A 4/1998 Harrelson
5,746,310 A 5/1998 Slomski
5,762,193 A 6/1998 Marco
5,791,463 A 8/1998 Negelen
5,816,391 A * 10/1998 Harris ..... B65D 71/44 206/427
5,845,776 A 12/1998 Galbierz et al.
5,878,876 A 3/1999 Galbierz et al.
5,960,945 A 10/1999 Sutherland
6,039,181 A 3/2000 Whiteside
6,059,099 A 5/2000 Galbierz
6,082,532 A 7/2000 Miess
6,145,656 A 11/2000 Marco
6,293,392 B1 9/2001 Galbierz
6,315,111 B1 11/2001 Sutherland
6,394,272 B1 5/2002 Domansky
6,896,130 B2 5/2005 Theelen

(56) References Cited

U.S. PATENT DOCUMENTS

| | | | | |
|---|---|---|---|---|
| D506,925 | S | 7/2005 | Plumer | |
| 7,011,209 | B2 | 3/2006 | Sutherland et al. | |
| 7,048,113 | B2 | 5/2006 | Gomes | |
| 7,360,647 | B2 | 4/2008 | Ogg | |
| 7,690,507 | B2 | 4/2010 | Sutherland | |
| 7,721,878 | B2 | 5/2010 | Requena | |
| 7,762,397 | B2 | 7/2010 | Coltri-Johnson et al. | |
| 7,789,231 | B2 * | 9/2010 | Requena | B65D 71/46 206/139 |
| 7,823,721 | B2 | 11/2010 | Sutherland et al. | |
| 7,913,844 | B2 | 3/2011 | Spivey, Sr. | |
| 8,056,709 | B2 | 11/2011 | Sutherland | |
| 8,096,413 | B2 | 1/2012 | DePaula | |
| 8,162,135 | B2 | 4/2012 | Oliveira | |
| 8,353,398 | B2 | 1/2013 | DePaula et al. | |
| 8,387,784 | B2 | 3/2013 | Gonzalez et al. | |
| 8,443,968 | B2 | 5/2013 | DePaula | |
| 8,464,866 | B2 | 6/2013 | Sutherland et al. | |
| 8,469,184 | B2 | 6/2013 | Spivey, Sr. | |
| 8,602,209 | B2 | 12/2013 | Jones et al. | |
| 8,631,932 | B2 | 1/2014 | Holley, Jr. | |
| 8,701,878 | B2 | 4/2014 | Spivey, Sr. | |
| 8,925,720 | B2 | 1/2015 | Sutherland et al. | |
| 8,936,149 | B2 | 1/2015 | Smalley | |
| 8,955,674 | B2 | 2/2015 | Spivey, Sr. et al. | |
| 9,079,699 | B2 | 7/2015 | Holley, Jr. | |
| 9,169,050 | B2 | 10/2015 | Spivey, Sr. | |
| 9,284,090 | B2 | 3/2016 | Lettre | |
| 9,359,093 | B2 | 6/2016 | DePaula et al. | |
| 9,376,250 | B2 | 6/2016 | Spivey, Sr. | |
| D767,408 | S | 9/2016 | Shuster | |
| 9,446,891 | B2 | 9/2016 | Jones et al. | |
| 9,511,916 | B2 | 12/2016 | Holley, Jr. | |
| 9,669,976 | B2 | 6/2017 | Kastanek et al. | |
| 9,676,535 | B2 | 6/2017 | Spivey, Sr | |
| 10,077,131 | B2 | 9/2018 | Lettre | |
| D881,021 | S | 4/2020 | Bandinu | |
| D881,718 | S | 4/2020 | Bandinu | |
| 10,836,550 | B2 | 11/2020 | Zacherle | |
| D918,057 | S | 5/2021 | L'Heureux | |
| D918,058 | S | 5/2021 | L'Heureux | |
| 11,014,727 | B2 | 5/2021 | McCree | |
| D920,809 | S | 6/2021 | Chesnet et al. | |
| D921,493 | S | 6/2021 | Chesnet | |
| D923,416 | S | 6/2021 | Luciano | |
| 11,027,904 | B2 | 6/2021 | McCree | |
| 11,027,905 | B2 | 6/2021 | Ford | |
| 11,180,301 | B2 | 11/2021 | Smalley | |
| D944,656 | S | 3/2022 | Spivey, Sr. | |
| D946,416 | S | 3/2022 | Smalley | |
| D946,417 | S | 3/2022 | Gonzalez Manzano | |
| D946,418 | S | 3/2022 | Gonzalez Manzano | |
| D946,419 | S | 3/2022 | Gonzalez Manzano | |
| D946,420 | S | 3/2022 | Gonzalez Manzano | |
| D946,421 | S | 3/2022 | Gonzalez Manzano | |
| 11,261,013 | B2 | 3/2022 | Smalley | |
| 11,286,094 | B2 * | 3/2022 | Gonzalez Manzano | B65D 71/42 |
| D955,889 | S | 6/2022 | Gonzalez Manzano | |
| D955,890 | S | 6/2022 | Gonzalez Manzano | |
| D956,574 | S | 7/2022 | Gonzalez Manzano | |
| 11,401,094 | B2 | 8/2022 | McCree | |
| 11,401,095 | B2 | 8/2022 | Rosenbrien | |
| 11,420,802 | B2 | 8/2022 | Kooc | |
| D962,789 | S | 9/2022 | Noel | |
| D974,923 | S | 1/2023 | Smalley | |
| 11,628,994 | B2 * | 4/2023 | McCree | B65D 71/72 206/153 |
| 2002/0195371 | A1 | 12/2002 | Brown | |
| 2003/0080004 | A1 | 5/2003 | Olsen et al. | |
| 2003/0213705 | A1 | 11/2003 | Woog | |
| 2004/0206639 | A1 | 10/2004 | Karlsson | |
| 2004/0211695 | A1 | 10/2004 | Karlsson | |
| 2004/0226833 | A1 | 11/2004 | Daniel | |
| 2005/0127151 | A1 | 6/2005 | Johnson | |
| 2005/0199513 | A1 | 9/2005 | Bakx et al. | |
| 2006/0255114 | A1 | 11/2006 | Hand et al. | |
| 2007/0080084 | A1 * | 4/2007 | Sutherland | B65D 71/46 206/434 |
| 2007/0163908 | A1 | 7/2007 | Sutherland | |
| 2008/0257763 | A1 | 10/2008 | Ogg | |
| 2009/0101526 | A1 | 4/2009 | Sutherland et al. | |
| 2009/0127147 | A1 | 5/2009 | Sutherland | |
| 2010/0078337 | A1 | 4/2010 | Sutherland et al. | |
| 2010/0264043 | A1 | 10/2010 | DePaula | |
| 2011/0000799 | A1 | 1/2011 | Gonzalez | |
| 2012/0080328 | A1 | 4/2012 | DePaula | |
| 2012/0138489 | A1 | 6/2012 | Holley, Jr. | |
| 2015/0191287 | A1 | 7/2015 | L'Heureux et al. | |
| 2016/0325899 | A1 | 11/2016 | L'Heureux et al. | |
| 2018/0111734 | A1 | 4/2018 | Jego | |
| 2018/0222650 | A1 | 8/2018 | Zacherle | |
| 2018/0362234 | A1 | 12/2018 | L'Heureux et al. | |
| 2019/0119019 | A1 | 4/2019 | Patton | |
| 2020/0010255 | A1 | 1/2020 | Zacherle et al. | |
| 2020/0079564 | A1 * | 3/2020 | Ford | B65D 71/44 |
| 2020/0189817 | A1 | 6/2020 | Smalley | |
| 2020/0189818 | A1 | 6/2020 | McCree | |
| 2020/0189819 | A1 | 6/2020 | McCree | |
| 2020/0189821 | A1 | 6/2020 | Smalley | |
| 2020/0189822 | A1 | 6/2020 | Smalley | |
| 2020/0223612 | A1 | 7/2020 | Swenson | |
| 2021/0061502 | A1 | 3/2021 | Johnston | |
| 2021/0094742 | A1 | 4/2021 | Gonzalez Manzano | |
| 2021/0276776 | A1 | 9/2021 | Zammit | |
| 2021/0316921 | A1 | 10/2021 | Holtz | |
| 2021/0331847 | A1 | 10/2021 | Gonzalez Manzano | |
| 2021/0331848 | A1 | 10/2021 | Gonzalez Manzano | |
| 2021/0339928 | A1 | 11/2021 | Blin | |
| 2022/0009685 | A1 | 1/2022 | Thompson | |
| 2022/0097941 | A1 | 3/2022 | McCree | |
| 2023/0019145 | A1 | 1/2023 | Thompson | |

FOREIGN PATENT DOCUMENTS

| | | | |
|---|---|---|---|
| DE | 298 13 672 | U1 | 11/1998 |
| DE | 203 19 247 | U1 | 5/2004 |
| DE | 10 2009 059 047 | A1 | 6/2011 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 1 340 691 | A1 | 9/2003 |
| EP | 1 401 727 | B1 | 6/2006 |
| EP | 1 910 187 | B1 | 3/2009 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| EP | 3 666 685 | A1 | 6/2020 |
| FR | 2 737 196 | A1 | 1/1997 |
| GB | 1 256 684 | | 12/1971 |
| GB | 2 221 666 | A | 2/1990 |
| GB | 2 321 229 | A | 7/1998 |
| GB | 9006736716 | | 8/2019 |
| GB | 2591535 | A | 8/2021 |
| GB | 6161591 | | 9/2021 |
| JP | 37-15730 | | 9/1960 |
| JP | 10-194330 | A | 7/1998 |
| JP | 10-297668 | A | 11/1998 |
| JP | 11-193059 | | 7/1999 |
| JP | 11-193059 | A | 7/1999 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| JP | 2016-124605 | | 7/2016 |
| KR | 10-2005-0051616 | A | 6/2005 |
| KR | 10-2020-0106806 | A | 9/2020 |
| KR | 301130233 | | 10/2021 |
| WO | WO 91/05716 | A1 | 5/1991 |

(56) References Cited

FOREIGN PATENT DOCUMENTS

| | | | |
|---|---|---|---|
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 95/10459 | A1 | 4/1995 |
| WO | WO 95/22495 | A1 | 8/1995 |
| WO | WO 96/26128 | A1 | 8/1996 |
| WO | WO 96/32340 | A1 | 10/1996 |
| WO | WO 03/016167 | A1 | 2/2003 |
| WO | WO 2006/044583 | A2 | 4/2006 |
| WO | WO 2008/058294 | A1 | 5/2008 |
| WO | WO 2010/006629 | A1 | 1/2010 |
| WO | WO 2010/101852 | A1 | 9/2010 |
| WO | WO 2016/100010 | A1 | 6/2016 |
| WO | WO 2016/112145 | A1 | 7/2016 |
| WO | WO 2020/210562 | A1 | 10/2020 |
| WO | WO 2021/168417 | A1 | 8/2021 |
| WO | WO 2021/188751 | A1 | 9/2021 |
| WO | WO 2021/262858 | A1 | 12/2021 |

OTHER PUBLICATIONS

"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).

Enviroclip. Date posted: 2022. Site visited: Sep. 12, 2022. Available online: https://www.graphicpkg.com/products/enviroclip/ (Year: 2022).

"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).

"The 'ECOGRIP' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).

Cap-it packaging video on Vimeo. Date posted: 2021. Site visited: Sep. 19, 2022. Available online: https://vimeo.com/610619455?embedded=true&source=vimeo_logo&owner=24551687 (Year: 2021).

2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).

International Search Report and Written Opinion for PCT/US2022/032608 dated Sep. 28, 2022.

International Search Report and Written Opinion for PCT/US2022/035207 dated Oct. 14, 2022.

International Search Report and Written Opinion for PCT/US2022/036297 dated Oct. 21, 2022.

International Search Report and Written Opinion for PCT/US2022/037069 dated Oct. 28, 2022.

International Search Report and Written Opinion for PCT/US2022/037071 dated Nov. 2, 2022.

International Search Report and Written Opinion for PCT/US2022/038638 dated Nov. 8, 2022.

International Search Report and Written Opinion for PCT/US2022/034840 dated Oct. 21, 2022.

* cited by examiner

CARRIER FOR CONTAINERS

CROSS-REFERENCE TO RELATED APPLICATIONS

This application claims the benefit of each of U.S. Provisional Patent Application No. 63/214,868, filed on Jun. 25, 2021, and U.S. Provisional Patent Application No. 63/219,896, filed on Jul. 9, 2021.

INCORPORATION BY REFERENCE

The disclosures of each of U.S. Provisional Patent Application No. 63/214,868, filed on Jun. 25, 2021, U.S. Provisional Patent Application No. 63/219,896, filed on Jul. 9, 2021, and U.S. Design patent application Ser. No. 29/838,178, filed on May 11, 2022, are hereby incorporated by reference for all purposes as if presented herein in their entirety.

BACKGROUND OF THE DISCLOSURE

The present disclosure generally relates to carriers or cartons for holding and carrying containers.

SUMMARY OF THE DISCLOSURE

According to one aspect, the disclosure is generally directed to a carrier for holding a plurality of containers, the carrier comprising an attachment panel having a plurality of container retention openings for at least partially receiving respective containers of the plurality of containers, and container retention features comprising the plurality of container retention openings and at least one container retention tab in at least partial face-to-face contact with the attachment panel and for being positioned between adjacent containers of the plurality of containers to urge the plurality of containers into engagement with the attachment panel.

According to another aspect, the disclosure is generally directed to a blank for forming a carrier for holding a plurality of containers, the blank comprising an attachment panel having a plurality of container retention openings for at least partially receiving respective containers of the plurality of containers, and container retention features comprising the plurality of container retention openings and at least one container retention tab for being positioned in at least partial face-to-face contact with the attachment panel and for being positioned between adjacent containers of the plurality of containers when the carrier is formed from the blank to urge the plurality of containers into engagement with the attachment panel.

According to another aspect, the disclosure is generally directed to a method of forming a carrier for holding a plurality of containers, the method comprising obtaining a blank comprising an attachment panel having a plurality of container retention openings for at least partially receiving respective containers of the plurality of containers, and container retention features comprising the plurality of container retention openings and at least one container retention tab. The method further comprises positioning the attachment panel with the plurality of container retention openings positioned to at least partially receive a respective container of the plurality of containers, and positioning the at least one container retention tab in at least partial face-to-face contact with the attachment panel for being positioned between adjacent containers of the plurality of containers to urge the plurality of containers into engagement with the attachment panel.

According to another aspect, the disclosure is generally directed to a package, the package comprising a plurality of containers and a carrier holding the plurality of containers. The carrier comprises an attachment panel having a plurality of container retention openings at least partially receiving respective containers of the plurality of containers, and container retention features comprising the plurality of container retention openings and at least one container retention tab in at least partial face-to-face contact with the attachment panel and positioned between adjacent containers of the plurality of containers to urge the plurality of containers into engagement with the attachment panel.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to constructs, sleeves, cartons, or the like, and packages for holding and displaying containers such as cans, jars, bottles, etc. The containers can be used for packaging food and beverage products, for example. The containers can be made from materials suitable in composition for packaging the particular food or beverage item, and the materials include, but are not limited to, aluminum and/or other metals, plastics such as PET, LDPE, LLDPE, HDPE, PP, PS, PVC, EVOH, and Nylon; and the like; glass; or any combination thereof.

Packages according to the present disclosure can accommodate containers of numerous different shapes. For the purpose of illustration and not for the purpose of limiting the scope of the disclosure, the following detailed description describes beverage containers (e.g., generally cylindrical containers such as aluminum cans) at least partially disposed within the package embodiments. In this specification, the terms "lower," "bottom," "upper" and "top" indicate orientations determined in relation to fully erected packages.

Figure 1:
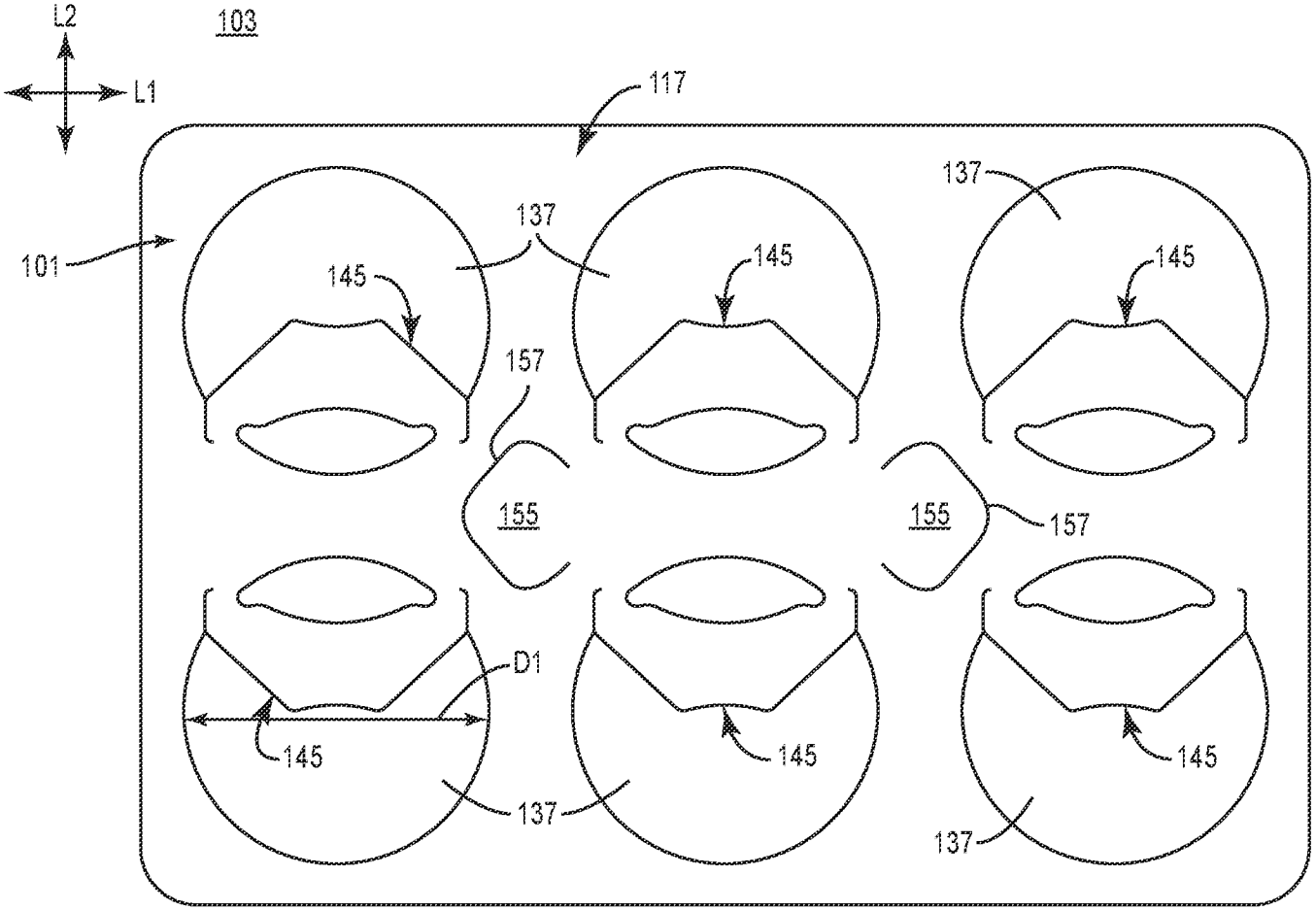
FIG. 1 is a plan view of a blank for forming a carrier according to a first exemplary embodiment of the disclosure.
Figure 1A:
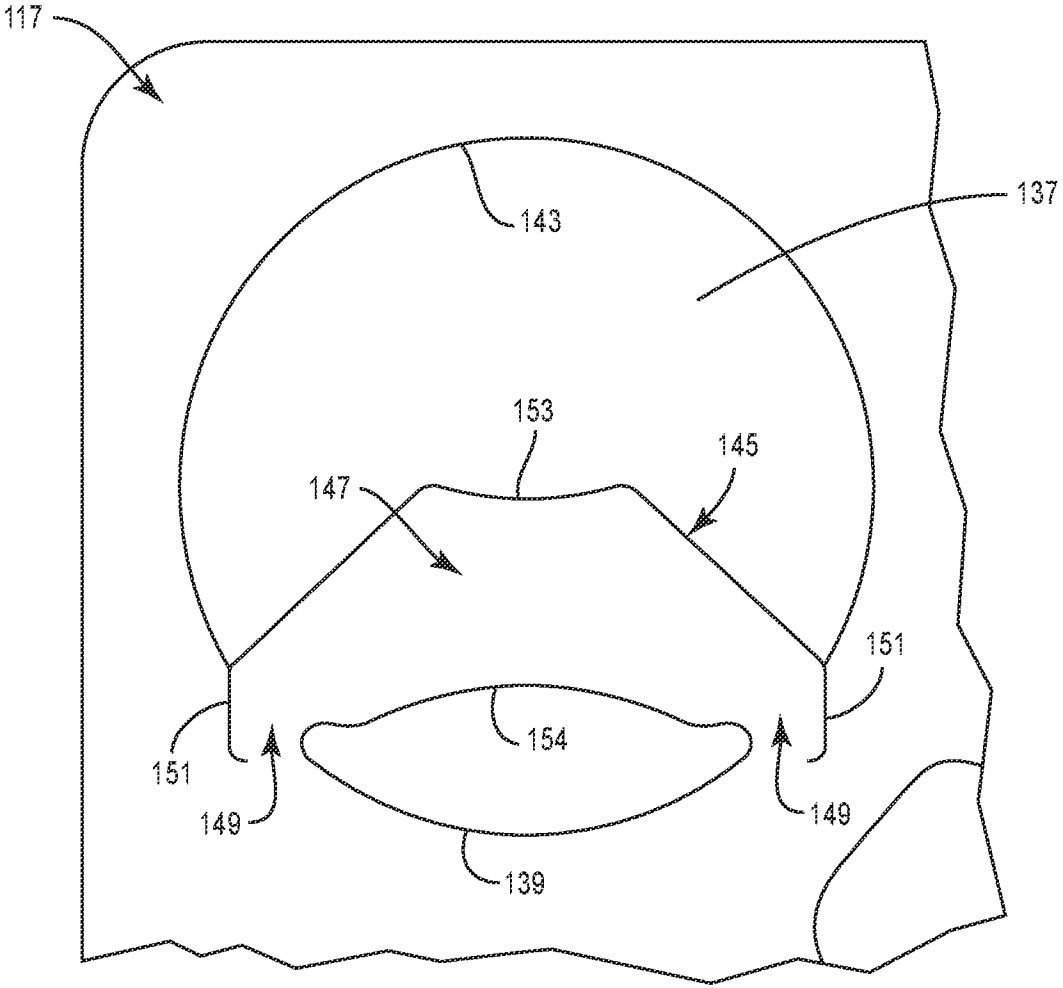
FIG. 1A is an enlarged view of a portion of the blank of FIG. 1.
Figure 4:
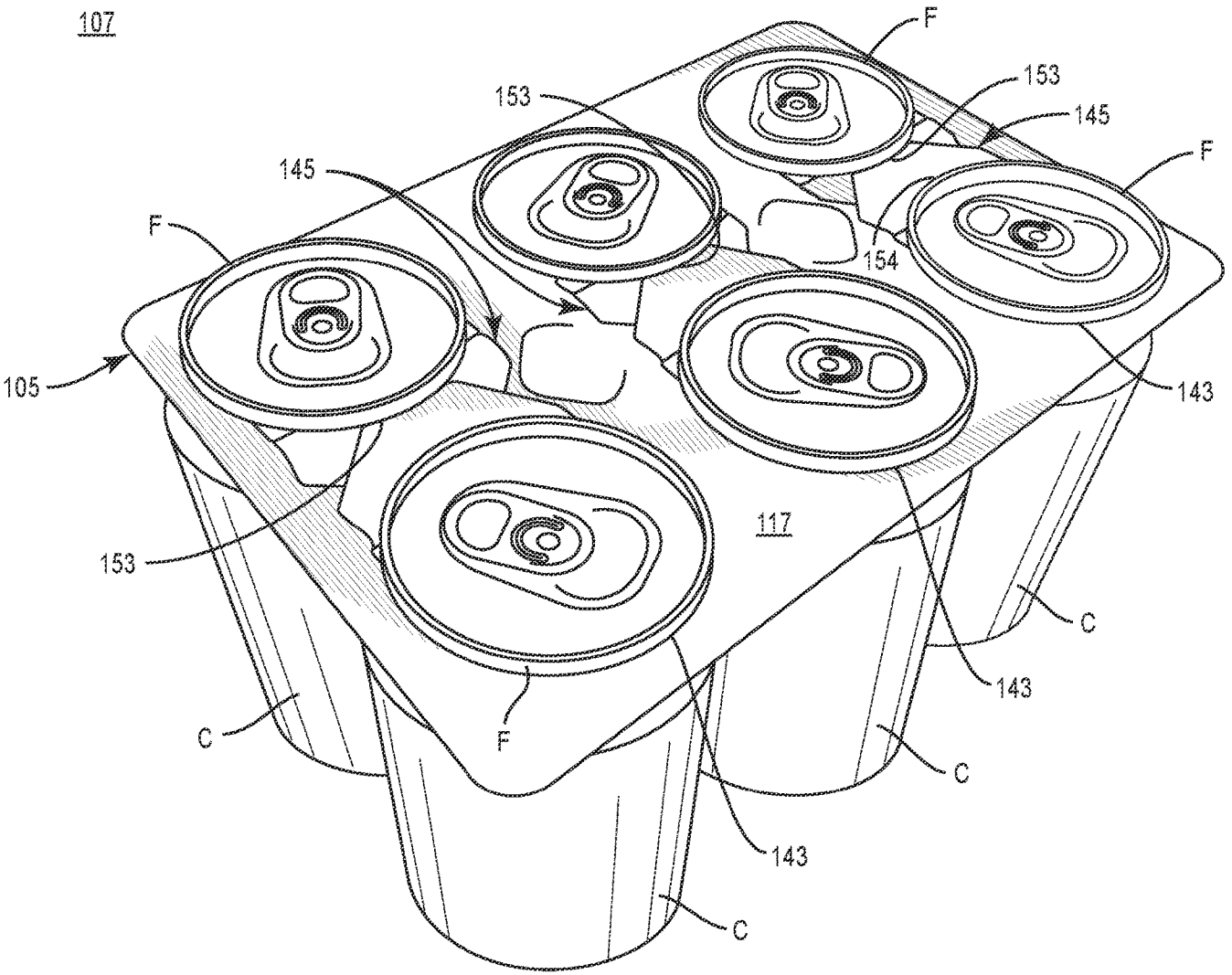
FIG. 4 is a perspective view of a package and carrier formed from the blank of FIG. 1 according to the first exemplary embodiment of the disclosure.

FIG. 1 is a plan view of an exterior surface 101 of a blank 103 used to form a carrier 105 (FIG. 4) according to a first exemplary embodiment of the disclosure. As described further herein, the carrier 105 can be configured for holding/supporting/retaining/receiving a plurality of containers C. The carrier 105 can be provided with one or more containers C to form a package 107 (FIG. 4).

Figure 2:
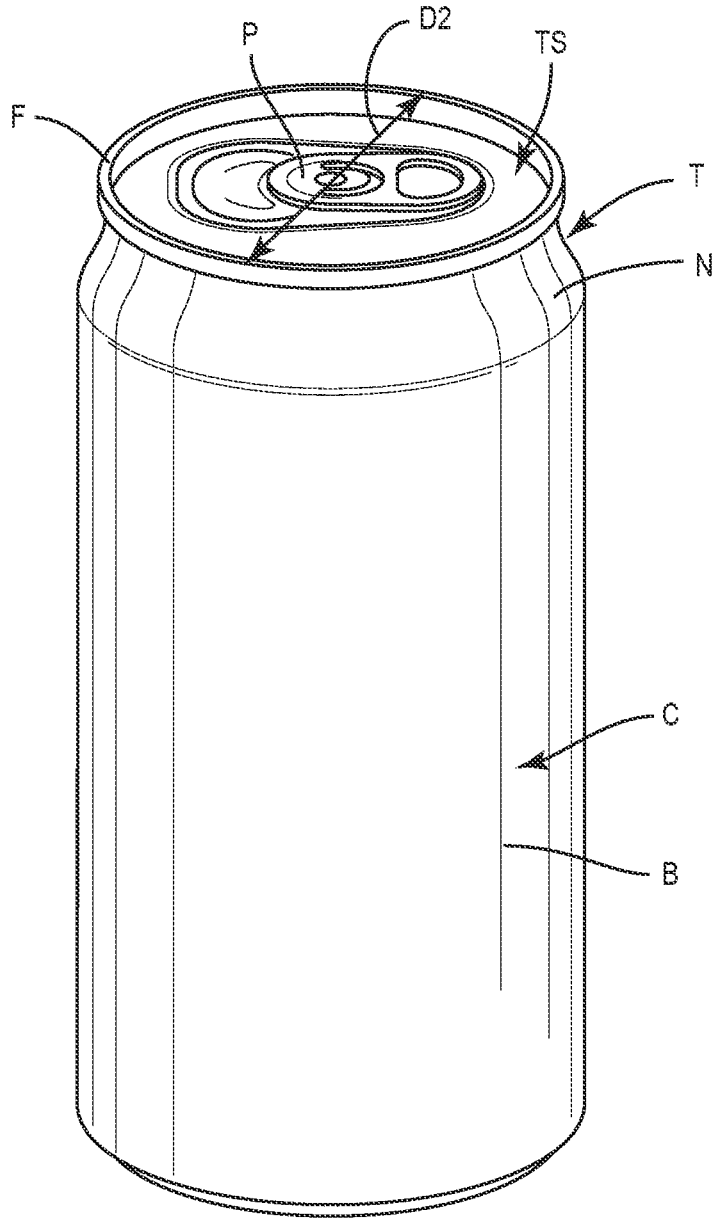
FIG. 2 is a perspective view of a container suitable for use with carriers according to embodiments of the present disclosure.

Referring momentarily to FIG. 2, containers C for use with the carriers of the present disclosure are illustrated as beverage containers having a lower base portion B, a top portion T generally comprising a neck N that tapers inwardly from the lower base portion, a flange portion F at the top of the neck portion that extends radially outward from the neck portion, and a top surface TS below the flange portion that includes a pull-tab P to facilitate opening of the container C. Containers of other sizes, shapes, and configurations, may be held in the carriers without departing from the disclosure.

The carrier 105 illustrated and described herein can support six containers, three containers in a front portion thereof and three containers in a back portion thereof. It will be understood that carriers can be sized and shaped to hold more or less than six containers, and/or in different arrangements, without departing from the disclosure. In one embodiment, the front portion and the back portion of the carrier 105 each have three containers, and in other embodiments, the front portion and the back portion of the carrier 105 can carry more or less than three containers without departing from the disclosure.

Still referring to FIG. 1, the blank 103 has a longitudinal axis L1 and a lateral axis L2. The blank 103 comprises a top or central or attachment panel 117 that includes container retention features for engaging containers C when the carrier 105 is formed from the blank 103. In the illustrated embodiment, the container retention features include six container retention openings 137 in the attachment panel 117, each at least partially defined by a first curved retention edge 139 and a second curved retention edge 143 opposite the first curved retention edge 139.

The container retention features can also include a plurality of container retention tabs 145 attached to the attachment panel 117, each container retention tab 145 having a central portion 147 extending across a portion of the respective openings 137 and a pair of extensions 149 extending from the attachment panel 117 to laterally outer portions of the respective central portions 147. In the illustrated embodiment, the extensions 149 are at least partially separable from the attachment panel 117 at a respective cut 151 or other line of weakening. In other embodiments, additional or alternative lines of weakening can be associated with one or more of the container retention tabs, e.g., so as to foldably connect the container retention tabs 145 to the attachment panel 117.

As shown, each container retention tab 145 has a first free edge that forms a first curved container retention tab edge 153 for engaging one or more containers of the plurality of containers C (broadly, "first container") when the carrier 105 is formed and an opposing second free edge that forms a second curved container retention tab edge 154 for engaging another one or more containers of the plurality of containers C (broadly, "second container") when the carrier 105 is formed. While the container retention tab edges 153, 154 are illustrated as generally curved free edges along the respective central portions 147 of the respective container retention tabs 145, it will be understood that the container retention tab edges can have a different configuration or arrangement, for example, having a different width and/or radius of curvature, without departing from the disclosure.

In the aforementioned arrangement, the extensions 149 of the container retention tabs 145 can be positioned so as to interrupt the curved retention edges 139, 143 around the respective container retention openings 137, e.g., so as to be intersecting/abutting respective endpoints thereof.

The retention edges 139, 143 can define respective radii of curvature that are substantially the same or equal, or, the retention edges 139, 143 can define different radii of curvature. In one embodiment, the openings 137 in the attachment panel 117 have a diameter D1 that is less than the outside diameter D2 of the flange F of the container C.

It will be understood that the shape and geometry of the edges 139, 143, or of other retention features of the blank 103/carrier 105, could vary to increase the retention forces applied to the container C and/or to accommodate various sizes and configurations of containers, without departing from the scope of the disclosure.

The blank 103/carrier 105 can also include handle features that include one or more finger flaps or handle flaps 155 defined by respective cuts 157 so as to be at least partially separable from the attachment panel 117. One or more lines of weakening, e.g., fold lines, can be provided to facilitate movement of the handle flaps 155 relative to the attachment panel 117. In one embodiment, the handle features of the blank 103/carrier 105 can include one or more cutouts formed in the attachment panel 117.

Figure 3:
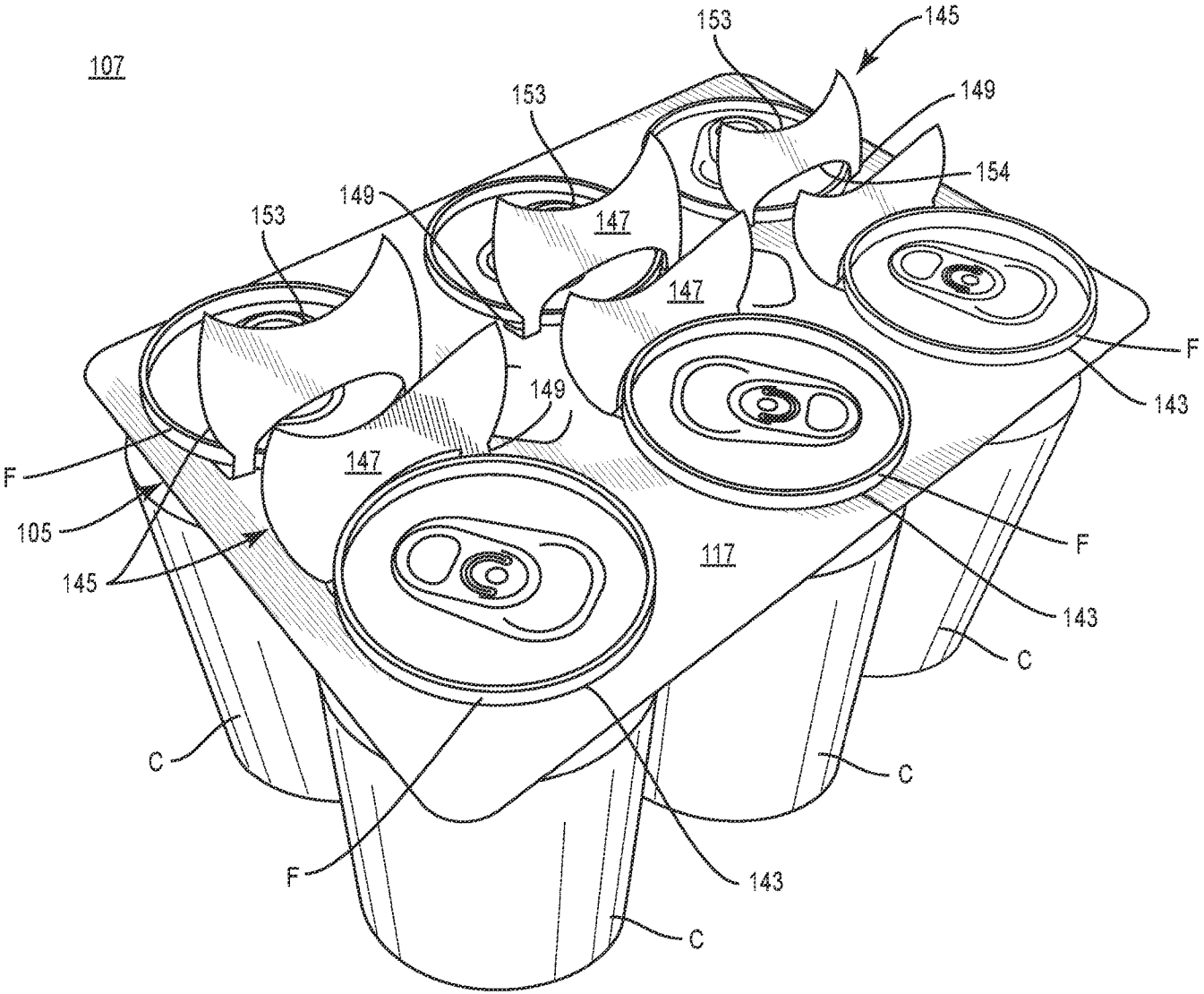
FIG. 3 is a perspective view of a partially formed configuration of a package and carrier formed from the blank of FIG. 1 according to the first exemplary embodiment of the disclosure.

Still referring to FIG. 1, and referring additionally to FIGS. 3 and 4, in one embodiment, a method of forming a package 107 that includes the carrier 105 and one or more of the containers C comprises obtaining the blank 103 and obtaining the group of containers C (e.g., six containers, but more or less than six containers can be included in the package). The blank 103 can be positioned on top of the group of containers C and the attachment panel 117 of the blank 103 is pushed downward so that least the flanges F of the containers C are inserted through a respective opening 137. In the illustrated embodiment, the diameter D1 of the container retention openings 137 can be less than the diameter D2 of the flange F of the containers C such that in order for the respective container retention openings 137 to receive the containers C through the respective container retention openings 137, the attachment panel 117 can flex/distort/bend or otherwise be manipulated to an at least partially non-planar configuration, without delaminating, damaging, or otherwise weakening the material of the blank 103/attachment panel 117 when the flanges F are inserted through the openings 137.

After pressing the blank 103 downward onto the containers C, the retention edges 139, 143 of the respective openings 137 can contact a respective container C at the neck portion N of the container C below the flange F.

In one embodiment, the containers C can be tilted or reoriented relative to the blank 103 to facilitate attachment of the attachment panel 117 and the containers C. For example, the containers C can be tilted toward the center of the attachment panel 117 and at least partially inserted through the openings 137. Thereafter, the lower base portions B of the containers C can be pivoted until the containers C are in a generally upright orientation extending at least partially through the openings 137, with the attachment panel 117 positioned with the neck portion N of the respective containers C below the respective flanges F. The above-described insertion of the containers C through the respective openings 137 and pivoting action of the containers C facilitates a gentle and relaxed engagement of the top portions T of the respective containers C with the portions of the attachment panel 117 surrounding the respective openings 137, so as to minimize flexing, stretching, or other reconfiguration of the board/material that forms the attachment panel 117.

In one embodiment, paperboard that forms the blank 103/carrier 105 can flex and stretch when such openings 137 are placed over the flanges F of the containers C, and may weaken at one or more points around the edges of the openings 137 to allow the flange F to fit through a respective opening 137 and allow the attachment panel 117 to be positioned below the flange F with the surrounding portion of the attachment panel 117 positioned to be generally horizontally and in contact with the neck N of the containers C.

Thereafter, the respective container retention tabs 145 can be folded or flexed backward, e.g., in the direction of the respective first container retention edges 139, so that the respective container retention tabs edges 154 are positioned facing the respective necks N of the respective containers C extending through the container retention openings 137 to which the container retention tabs 145 are connected, and such that the respective container retention tab edges 153 are positioned facing the respective necks N of the respective containers C extending through the laterally adjacent container retention openings 137 of the carrier 105.

In such position, a respective container retention tab edge 154 can be positioned proximate or overlying the respective container retention edge 139 of the container opening 137 from which the container retention tab 145 extends, e.g., so as to be positioned between the flange F of the respective container C (broadly, "second container") and the attachment panel 117/respective container retention edge 139. Further, the respective container retention tab edge 153 can be positioned proximate or overlying the container retention edge 143 of a laterally adjacent container opening 137, e.g., so as to be positioned between the flange F of the respective container C (broadly, "first container") and above the attachment panel 117/respective container retention edge 137.

Further still, since the container retention tabs 145 associated with laterally adjacent container retention openings 137 are bent/folded toward one another, the container retention tabs 145 can be positioned in an at least partially overlapping arrangement in which one or more portions of such overlapped container retention tabs 145 are in at least partial face-to-face contact (broadly, "first container retention tab" and "second container retention tab"). The overlapped container retention tabs 145 can thus provide a multi-ply, e.g., 2-ply, structure atop the attachment panel 117, and a 3-ply structure in conjunction with the attachment panel 117.

This arrangement can enhance the engagement of the container retention edges 137, 139 with the respective containers C, e.g., by taking up remaining available empty space/clearance between the retention edge 153, 154 and the neck N/flange F of the respective container C against which they abut. Furthermore, the arrangement of the extensions 149 and/or the biasing/stress exerted by the paperboard material of the carrier 105 can urge each container retention tab 145 to press the respective containers C outwardly away from the longitudinal axis L1, e.g., along the lateral axis L2, to urge the respective necks N of the containers C into a tighter/more secure engagement with one or both of the respective container retention edges 139, 143.

In this regard, the container retention tabs 145 can be formed from material from the blank 103/carrier 105 that would otherwise be discarded during the formation of the features of the carrier 105 to provide enhanced container retention features that maximizes materials savings. Additionally, the marginal portions of the attachment panel 117 that extend around the respective openings 137 forms a continuous portion of board/material of the attachment panel 117 that is free from folds, cuts, tears, or other forms of weakening such that these marginal portions have enhanced strength properties, thus resulting in stronger attachment of the containers C to the carrier 105. Accordingly, when the containers C are attached to the attachment panel 117, the marginal portions of the attachment panel 117 are positioned in an approximately horizontal and coplanar arrangement relative to the remainder of the top panel 117 to contact the containers C at opposed surfaces of the neck N below the flange F.

Once the containers C are at least partially received in the openings 137 and secured to the attachment panel 117 to form the carrier 105 and package 107, the carrier 105/package 107 can be grasped by at least partially separating one or more of the handle flaps 155 at the respective cuts 157 and at least partially bending/folding said handle flaps 155 away from the attachment panel 117 to form openings through which the carrier 105/package 107 can be grasped by a user.

In one embodiment, the flanges F of the containers C can have a diameter D2 corresponding to an outer edge thereof of approximately 53 mm and the openings 137 in the attachment panel 117 can have a diameter D1 of approximately 52 mm. The flanges F, openings 137, or other portions of the containers C or carrier 105 can have a different diameter without departing from the disclosure, for example, 58 mm or 56 mm.

Furthermore, the blank 103 can have features that are otherwise shaped, configured, dimensioned, and/or positioned without departing from the disclosure. All dimensional information presented herein is illustrative of an exemplary embodiment of the disclosure and is not intended to limit the scope of the disclosure as any dimension presented herein can be more or less than the specific dimensions disclosed herein.

Figure 5:
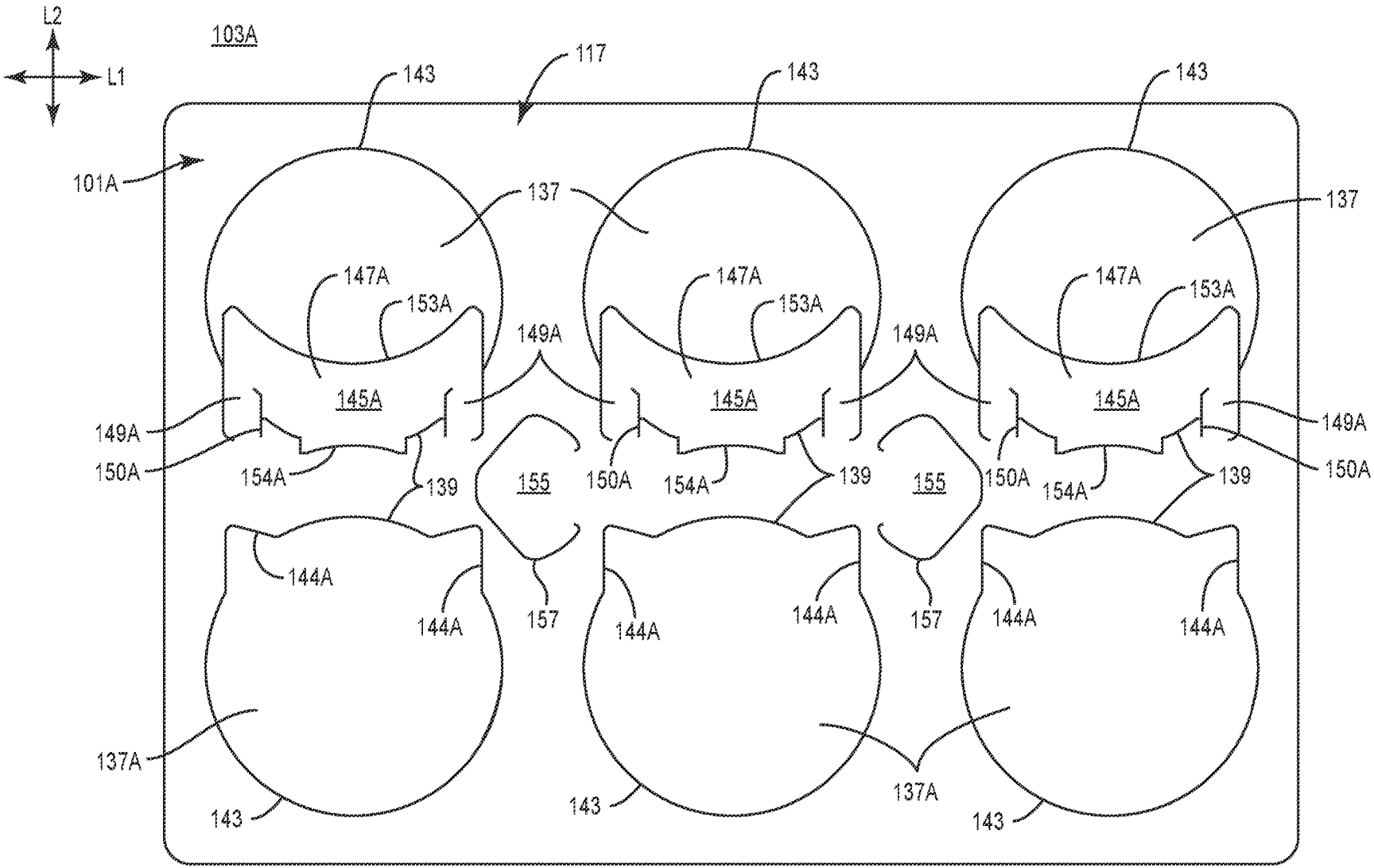
FIG. 5 is a plan view of a blank for forming a carrier according to an alternative configuration of the first exemplary embodiment of the disclosure.

For example, FIG. 5 illustrates an exterior surface 101A of an alternative exemplary embodiment of the blank 103, generally designated 103A, for forming a carrier 105A (FIG. 5A) and package 107A (FIG. 5A) according to an alternative exemplary embodiment of the disclosure. The blank 103A and package and carrier formed therefrom can have one or more features that are the same or similar to those described above with respect to the blank 103, package 107, and carrier 105, and like or similar features are designated with like or similar reference numerals.

As shown, the blank 103A can have the attachment panel 117 with the container retention openings 137 and the handle flaps 155 and associated features. A respective container retention opening 137A can be provided laterally adjacent each respective container retention opening 137. Each container retention opening 137A can include the edges 139, 143, with respective oblique or tapered cutouts 144A provided therebetween, e.g., so as to be intersecting/abutting respective endpoints thereof.

In addition, the blank 103A includes container retention tabs 145A positioned extending into the respective container retention openings 137, each container retention tab 145A having a central portion 147A that is generally longer along the lateral axis L2 than the central portions 147 described above. As shown, the central portions 147A of the respective container retention tabs 145A can interrupt and extend past the respective container retention edges 139 to provide container retention tab edges 154A defined by respective curved cuts. As also shown, the container retention tab edges 153A of the respective container retention tabs 145A can be generally wider and have a larger radius of curvature than the container retention tab edges 153 described above.

A pair of extensions 149A extend from the attachment panel 117 to laterally outer portions of the respective central portions 147A. In the illustrated embodiment, the extensions 149A can be generally longer along the lateral direction L2 relative to the extensions 149A described above, and respective lines of weakening 150A can be provided between the respective central portions 147A and the respective extensions 149A to facilitate at least partial separation thereof. The lines of weakening 150A can have one or more of straight, angled, and/or curved portions, as shown.

Figure 5A:
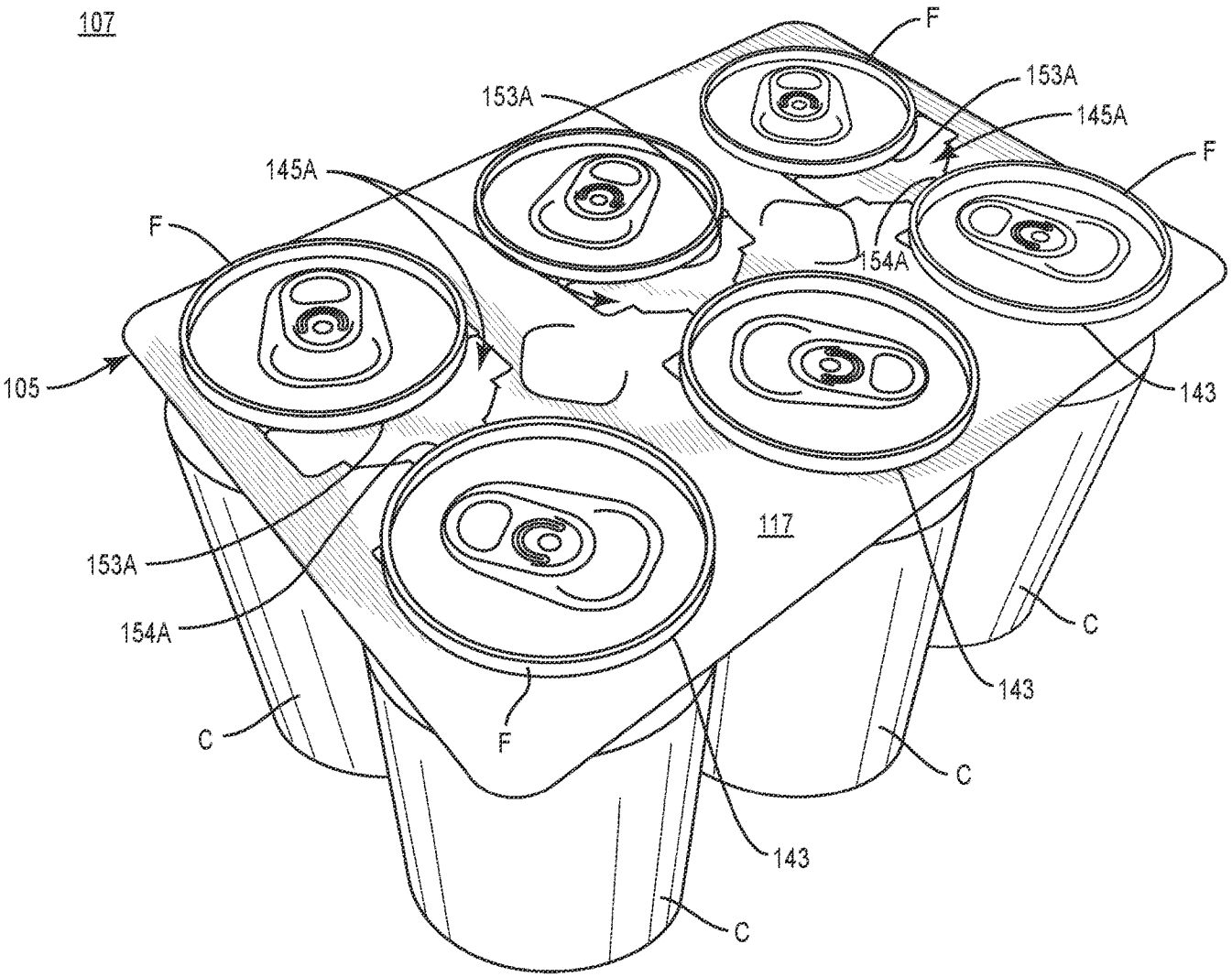
FIG. 5A is a perspective view of a package and carrier formed from the blank of FIG. 5 according to the alternative configuration of the first exemplary embodiment of the disclosure.

With additional reference to FIG. 5A, the blank 103 can be positioned to at least partially receive respective containers of the plurality of containers C through the respective container retention openings 137, 137A in the manner described above with regard to the blank 103/carrier 105/package 107. In some embodiments, the cutouts 144A along the openings 137A can permit additional relative movement and flexibility of the attachment panel 117 and/or provide an increased area to facilitate receipt of one or more portions of respective containers C therethrough.

Formation of the carrier 105A and package 107A from the blank 103A can continue substantially as described above with regard to formation of the carrier 105 and package 107 from the blank 103. The respective container retention tabs 145A can be folded or flexed backward, e.g., in the direction of the respective first container retention edges 139, so that the respective container retention tabs edges 154A are positioned facing the respective necks N of the respective containers C extending through the container retention openings 137 to which the container retention tabs 145A are connected, and such that the respective container retention tab edges 153A are positioned facing the respective necks N of the respective containers C extending through the laterally adjacent container retention openings 137A.

As described herein, movement of the container retention tabs 145A can include at least at least partial folding at one or more intermediate positions along the respective extensions 149A, e.g., such that at least a portion of the central portion 147A is positioned into at least partial face-to-face contact with at least a portion of the extensions 149A. In some embodiments, at least a portion of a respective extension 149A can be positioned in at least partial face-to-face contact with another portion of the respective extension 149A. Such movement/folding of one or more portions of the container retention tabs 145A can involve at least partial separation of a respective extension 149A from a respective central portion 147A thereof at a respective line of weakening 150A. The aforementioned folding sequence of respective container retention tabs 145A can provide the container retention tab 145A along the attachment panel 117 in an orientation in which the exterior surface 101A of the blank 103A and carrier formed therefrom is presented, e.g., so as to minimize exposure of portions of the blank 103A and carrier formed therefrom to a customer or other user, for example, for overall aesthetics, to provide additional surface area for printed graphics and/or other indicia, etc.

In such position, a respective container retention tab edge 154A can be positioned proximate or overlying the respective container retention edge 139 of the container opening 137 from which the container retention tab 145A extends, e.g., so as to be positioned between the flange F of the respective container C and the attachment panel 117/respective container retention edge 139. Further, the respective container retention tab edge 153A can be positioned proximate or overlying the container retention edge 143 of a laterally adjacent container opening 137A, e.g., so as to be positioned between the flange F of the respective container C and above the attachment panel 117/respective container retention edge 137. Such engagement of the container retention tabs 145A with respective containers C provides and can enhance the advantages described above with regard to the blank 103/carrier 105/package 107.

Figure 6:
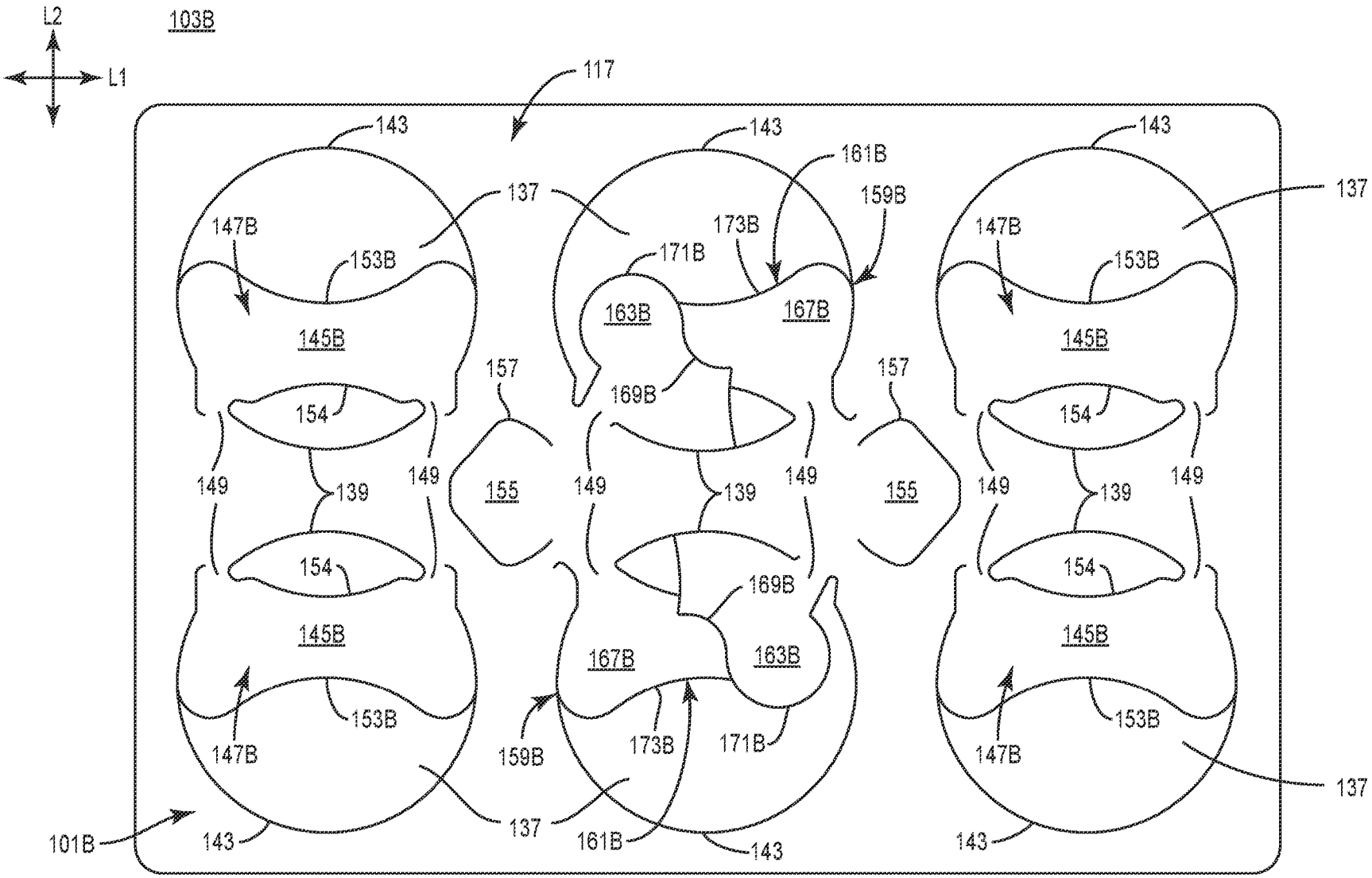
FIG. 6 is a plan view of a blank for forming a carrier according to another alternative configuration of the first exemplary embodiment of the disclosure.
Figure 6A:
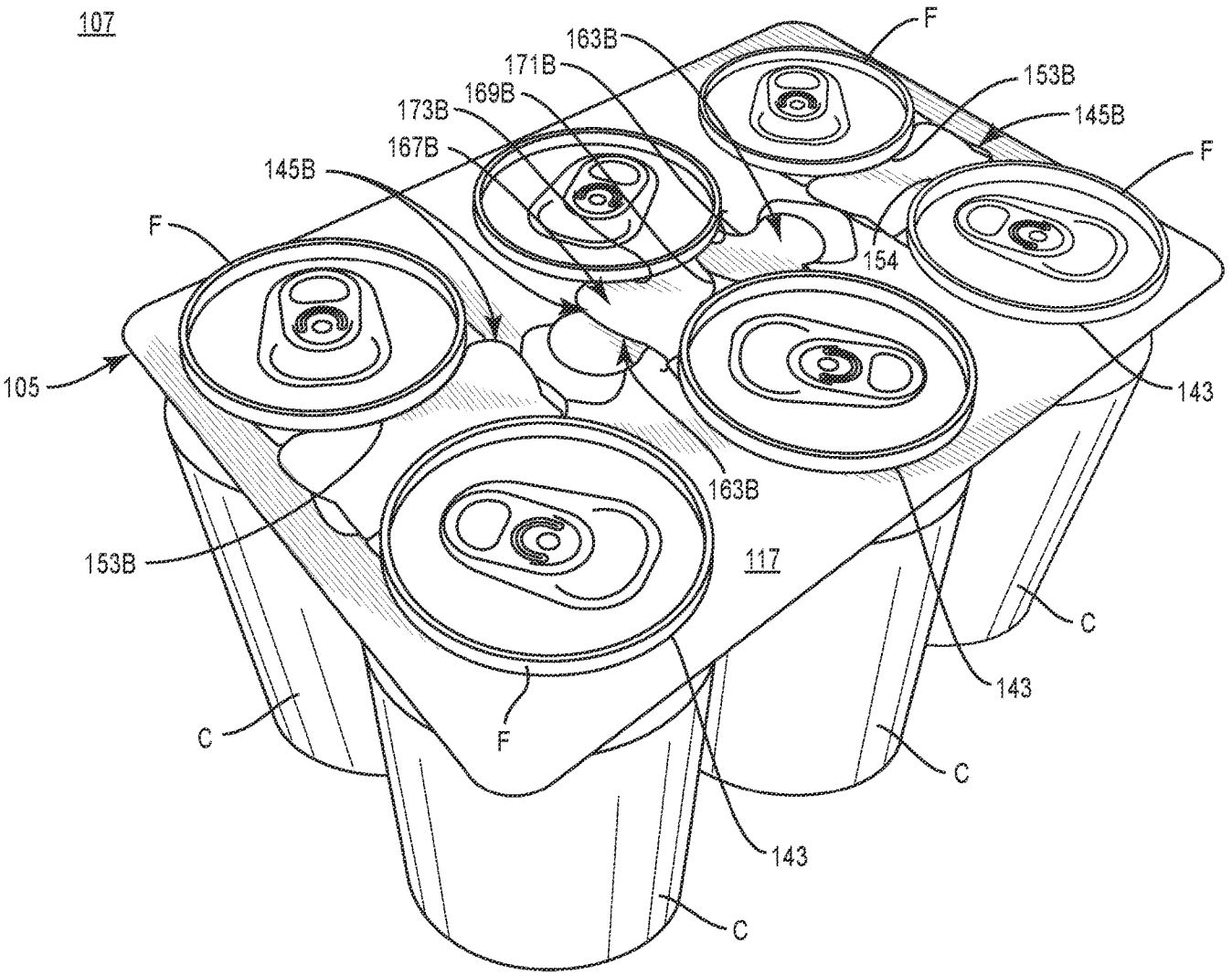
FIG. 6A is a perspective view of a package and carrier formed from the blank of FIG. 6 according to the alternative configuration of the first exemplary embodiment of the disclosure.

Turning to FIG. 6, an exterior surface 101B of another alternative exemplary embodiment of the blank 103 is generally designated 103B. The blank 103B can be for forming a package 105B (FIG. 6A) and carrier (FIG. 6A) that can have one or more features that are the same or similar to those described above with respect to the blanks 103, 103A, packages 107, 107A, and carriers 105, 105A and like or similar features are designated with like or similar reference numerals.

As shown, the blank 103B can have the attachment panel 117 with the container retention openings 137 and the handle flaps 155 and associated features. The blank 103B also includes container retention tabs 145B positioned extending into respective longitudinally outer container retention openings 137, and container retention tabs 159B positioned extending into the longitudinally centrally positioned container retention openings 137. It will be understood that a different number and/or arrangement of container retention tabs 145B, 159B can be provided without departing from the disclosure.

Each container retention tab 145B can be generally similar to the container retention tabs 145 described above, though having a container retention tab edge 153B that is generally wider and having a larger radius of curvature than the container retention tab edges 153 described above.

The container retention tabs 159B, as shown, can have a central portion 161B that includes a first portion 163B extending from a respective extension 149 and a second portion 167B extending from a respective extension 149 and separated from the first portion 163B at a cut 169B having one or more of straight, curved, and/or angled portions, as shown. In this regard, the first portion 163B of the central portion 161B can have a first container retention tab edge 171B at least partially defined along the cut 169B, and the second portion 167B of the central portion 161B of the container retention tabs 159B can form a second container retention tab edge 173B.

As also shown, the extensions 149 associated with the respective first portions 163B and second portions 167B of the respective container retention tabs 159B can be circumferentially offset relative to the extensions 149 associated with the container retention tabs 145B.

Formation of the carrier 105B and package 107B from the blank 103B can proceed substantially as described above with regard to formation of the carriers 105, 105A and packages 107, 107A from the respective blanks 103, 103A. The respective container retention tabs 145B can be folded or flexed backward, e.g., in the direction of the respective first container retention edges 139, so that the respective container retention tab edges 154 are positioned facing the respective necks N of the respective containers C extending through the container retention openings 137 to which the container retention tabs 145B are connected, and such that the respective container retention tab edges 153B are positioned facing the respective necks N of the respective containers C extending through the laterally adjacent container retention openings 137.

The container retention tabs 159B can also be folded or flexed backward as described above with regard to the container retention tabs 145B, with the container retention tab edges 171B, 173B of the respective first portion 163B and second portion 167B of the respective central portions 161B positioned facing the respective necks N of the respective containers C extending through the container retention openings 137 to which the container retention tabs 145B are connected.

However, such movement of the container retention tabs 159B can include at least partial separation of the respective first portion 163B and second portion 167B of the respective central portions 161B at the respective cuts 169B to allow the first portions 163B and second portions 167B to travel apart in the longitudinal direction L1. In some embodiments, the positioning of the extensions 149 associated with the container retention tabs 159B can facilitate such relative movement of the respective first portions 163B and second portions 167B along the longitudinal direction L1. Such movement of the container retention tabs 159B can permit additional flexibility of the attachment panel 117 in the course of at least partially receiving respective containers C through the respective container retention openings 137, during carrying of the carrier and package formed from the blank 103B, etc., while maintaining a secure engagement with a respective container C to which they extend.

The carrier 105B and package 107B formed from the blank 103B can thus provide and enhance the advantages described above with regard to the blank 103/carrier 105/package 107.

Figure 7:
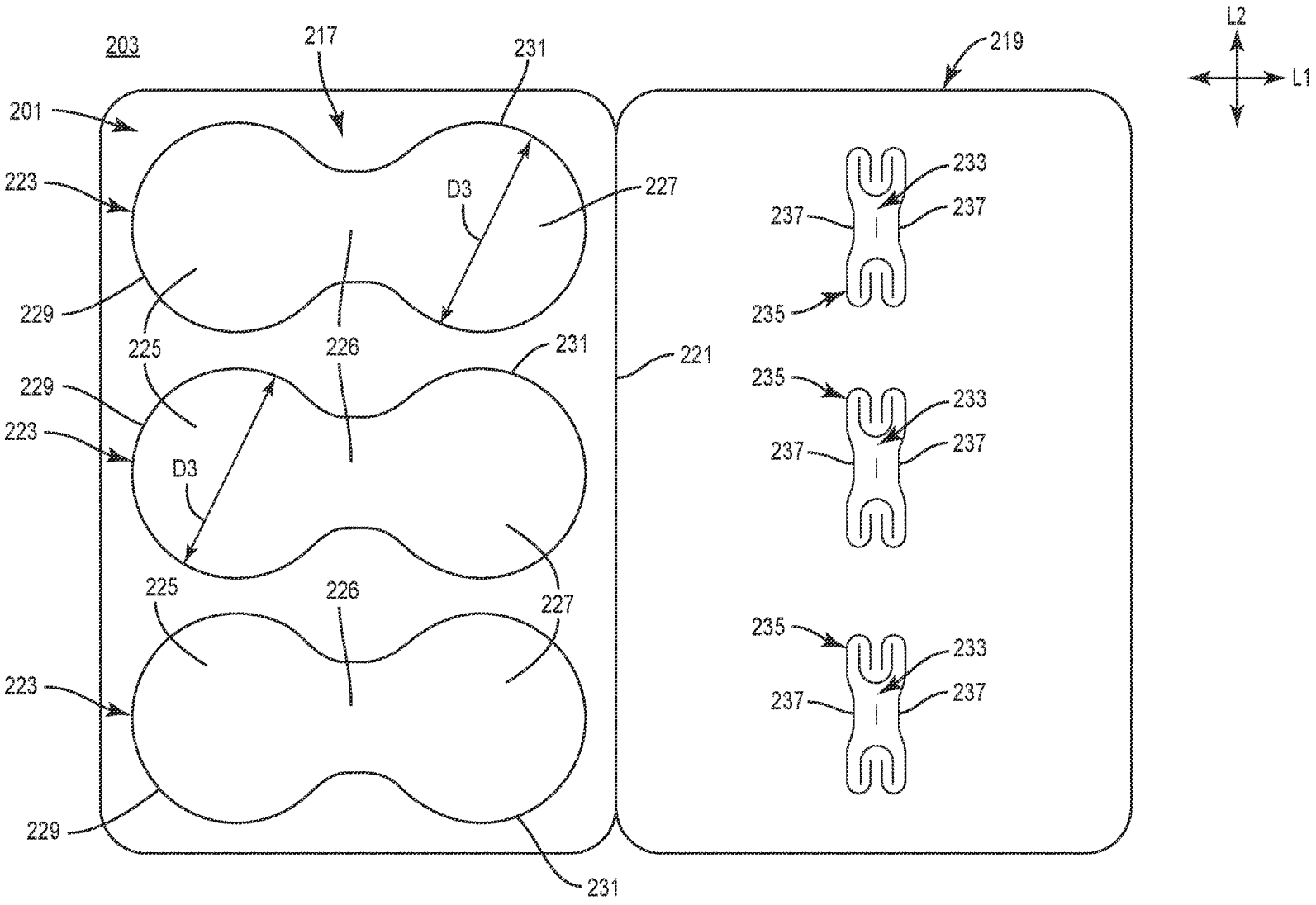
FIG. 7 is a plan view of a blank for forming a carrier according to a second exemplary embodiment of the disclosure.
Figure 8:
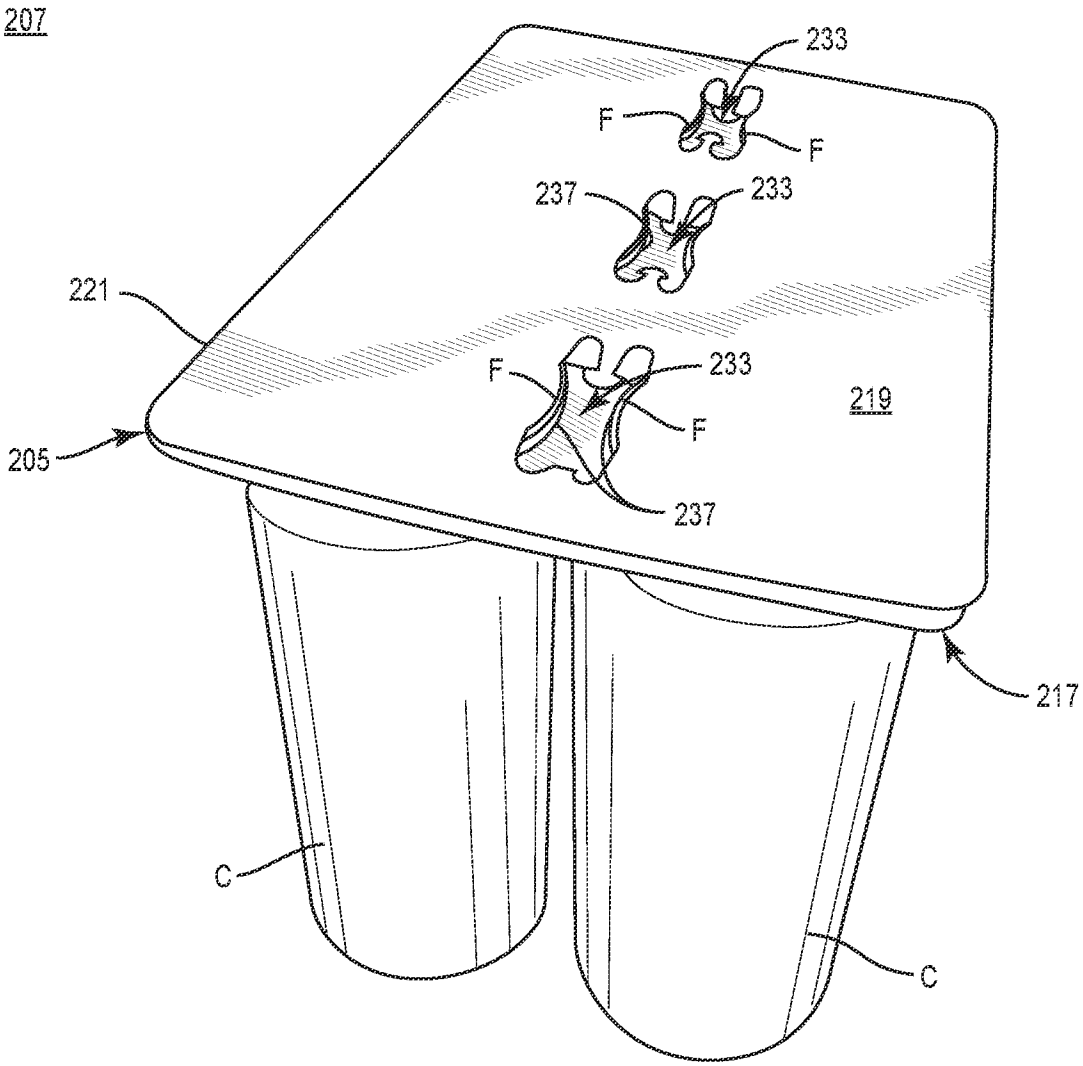
FIG. 8 is a plan view of a perspective view of a package and carrier formed from the blank of FIG. 7 according to the second exemplary embodiment of the disclosure.

FIG. 7 is a plan view of an exterior surface 201 of a blank 203 used to form a carrier 205 (FIG. 8) according to a second exemplary embodiment of the disclosure. As described further herein, the carrier 205 can be configured for holding/supporting/retaining/receiving a plurality of containers C. The carrier 205 can be provided with one or more containers C to form a package 207 (FIG. 8).

The blank 203/carrier 205/package 207 can have one or more features that are substantially similar or the same as those described above with respect to the blanks 103, 103A, 103B and carriers 105, 105A, 105B/packages 107, 107A, 107B of the first exemplary embodiment, and like or similar features are referenced with like or similar numerals.

The blank 203 has the longitudinal axis L1 and the lateral axis L2 and comprises an attachment panel 217 foldably connected to a top panel 219 at a lateral fold line 221. One or both of the panels 217, 219 can be provided with container retention features for facilitating attachment to one or more containers C, as described further herein.

As shown, the attachment panel 217 can include a plurality of laterally-spaced container retention openings 223, each container retention opening 223 having a first generally circular portion 225 in communication with a second generally circular portion 227, with a narrowing central portion 226 positioned between the first portion 225 and the second portion 227 such that the container retention openings 223 have a generally peanut-shaped profile. It will be understood that the container retention openings 223 can be provided in a different configuration or arrangement without departing from the disclosure. For example, in one embodiment, the first portion 225 and the second portion 227 of each container retention opening 223 can be provided as separate generally circular openings, with no communication therebetween.

In this regard, a first curved retention edge 229 extends around each first portion 225 of each container retention opening 223 for at least partially engaging a container C and a second curved retention edge 231 of the attachment panel 217 surrounds each second portion 227 of each container retention opening 223 for engaging a container C.

With continued reference to FIG. 7, the top panel 219 can include a plurality of container retention tabs 233 at least partially separably connected to the top panel 219 at a respective line of weakening 235. In the illustrated embodiment, the lines of weakening 235 can have one or more of curved, angled, and/or straight portions so as to at least partially define generally butterfly closure-shaped or gene pair-shaped container retention tabs 233. The container retention tabs 233 can thus be formed to have a lateral pair of generally curved container retention tab edges 237, each for engaging a respective container C. In the illustrated embodiment, the container retention tabs 233 can have the general form of a butterfly closure or gene pair, though one or more of the container retention tabs 233 can have a different configuration without departing from the disclosure.

The container retention tabs 233 can also include one or more additional lines of weakening, e.g., crease lines, fold lines, etc., along one or more portions thereof to facilitate relative movement of one or more portions of the respective container retention tabs 233, as described further herein.

Turning to FIG. 8, in order to form the carrier 205/package 207 according to one exemplary embodiment of the disclosure, the blank 203 can be inverted, e.g., with the exterior surface 201 facing downwardly, and can be positioned on top of the group of containers C and the attachment panel 217 of the blank 203 can be pushed downward so that the flanges F of the containers are inserted through a respective opening 223.

In the illustrated embodiment, the diameter D3 of the respective first portion 225 and second portion 227 of the respective container retention openings 223 can be less than the diameter D2 of the flange F of the containers C such that in order to receive the containers C through the respective container retention openings 223, the attachment panel 217 can flex/distort/bend or otherwise be manipulated to an at least partially non-planar configuration, without delaminating, damaging, or otherwise weakening the material of the blank 203/attachment panel 217 when the flanges F are inserted through the respective openings 223. In one embodiment, the central portions 226 of the respective container retention openings 223 can bend/flex/twist/distort/etc., in order to facilitate at least partial receipt of the containers C through the respective portions 225, 227 of the respective container retention openings 223.

After pressing the attachment panel 217 downward onto the containers C, the retention edges 229, 231 of the respective container retention openings 223 contact a respective container C at the neck portion N of the container C below the flange F.

It will be understood that the containers C can additionally or alternatively be tilted or otherwise reoriented to facilitate at least partial receipt of the containers C by the respective container retention openings 223 as described above with regard to the receipt of the containers C by the container retention openings 137 of the carrier 105. In one embodiment, paperboard that forms the blank 203/carrier 205/package 207 can flex and stretch when such openings are placed over the flanges F of the containers C to allow the flange F to fit through a respective opening 223 and allow the attachment panel 217 to be positioned below the flange F with the surrounding portion of the attachment panel 217 positioned to be generally horizontally and in contact with the neck N of the containers C.

Thereafter, the top panel 219 can be folded at the fold line 221 into at least partial face-to-face contact with the attachment panel 217 so as to overlie the top portions T of the containers C. In such an arrangement, an at least partial clearance/spacing is provided between the top panel 219 and the attachment panel 217. Accordingly, the container retention tabs 233 can be at least partially separated from the top panel 219 at the respective lines of weakening 231 and positioned downwardly between the necks N of a respective pair of containers C. Accordingly, the container retention tabs 229 can be positioned in at least partial face-to-face contact with the attachment panel 117.

In such an arrangement, the container retention tabs 233 can be generally aligned with the central portion 226 of the respective container retention openings 223 of the attachment panel 217 and between the necks N of longitudinally adjacent containers C. This position of the container retention tabs 233 is such that the container retention tab edges 237 face the respective necks N of the respective containers C to press the respective containers C outwardly away from the lateral axis L2, e.g., to urge the respective necks N of the containers C into a tighter/more secure engagement with the respective retention edges 229, 231.

In some embodiments, the container retention tabs 233 can be partially separated from the top panel 219 at the respective lines of weakening 235, e.g., such that one or more portions of the respective container retention tab 233 remains attached to the top panel 219, with one or more central portions of the respective container retention tabs 233 flexing, bowing, curving, etc., downwardly to position the container retention tab edges 237 facing the respective necks N of the respective containers C as described above. In other embodiments, the container retention tabs 233 can be fully separated from the top panel 219 so as to be positioned between the necks N of respective containers C as described above.

Furthermore, the positioning of the predominantly uninterrupted top panels 219 over the attachment panel 217 can provide a uniform or clean appearance that is appealing to a customer. Furthermore, such overlap of the top panel 219 over the majority of the containers C can inhibit, minimize, prevent, and/or otherwise avoid debris or other incidental materials from contacting the upper portions of the containers C.

The features of the blank 203/carrier 205 could be otherwise shaped, arranged, and/or configured without departing from the disclosure. For example, in some embodiments, container retention tabs can be formed by respective pairs of spaced cuts having one or more of straight, curved, and/or angled portions.

Figure 9:
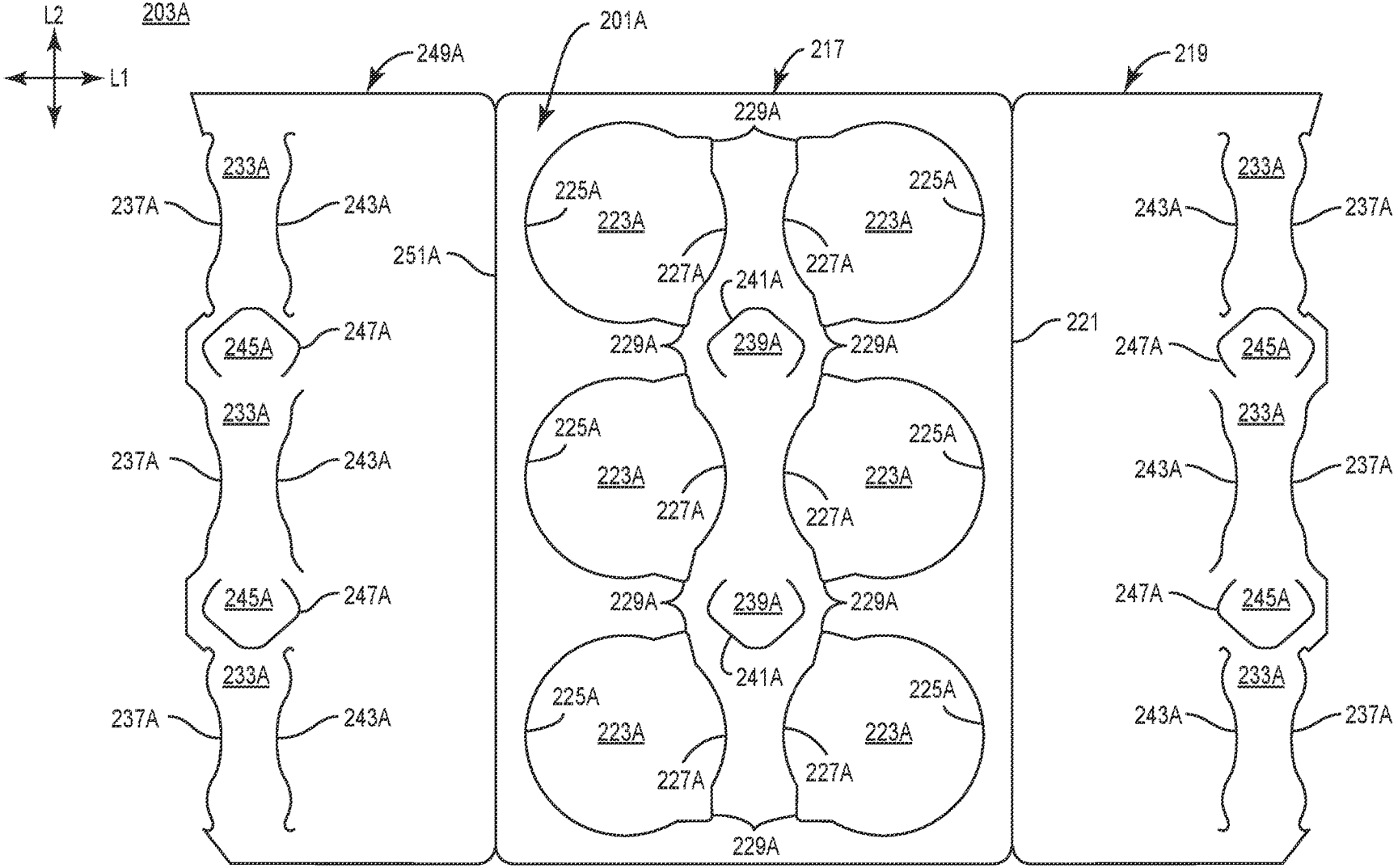
FIG. 9 is a plan view of a blank for forming a carrier according to an alternative configuration of the second exemplary embodiment of the disclosure.
Figure 9A:
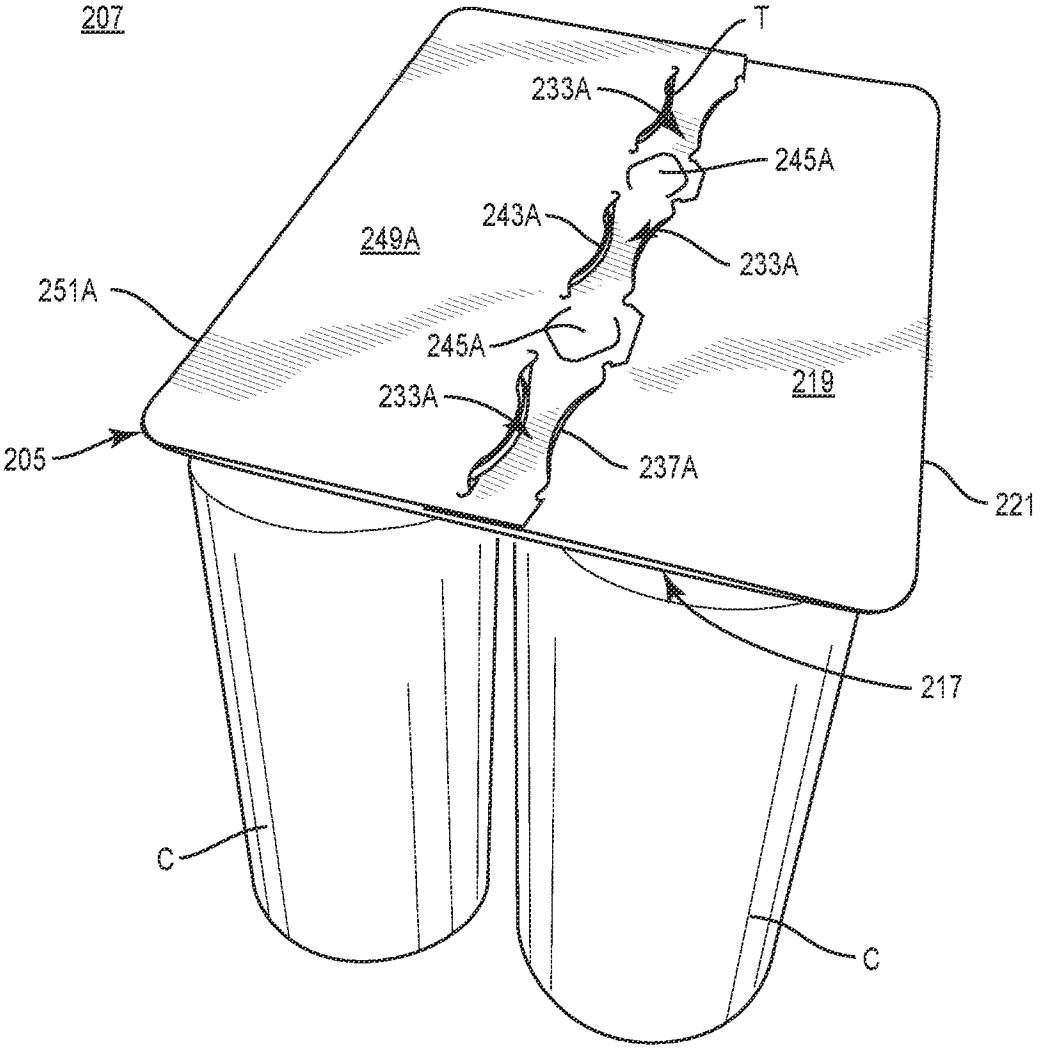
FIG. 9A is a perspective view of a package and carrier formed from the blank of FIG. 9 according to the alternative configuration of the second exemplary embodiment of the disclosure.

Turning to FIG. 9, an exterior surface 201A of an alternative exemplary embodiment of the blank 203 is generally designated 203A. The blank 203A can be for forming a package 205A (FIG. 9A) and carrier 207A (FIG. 9A) that can have one or more features that are the same or similar to those described above with respect to the blank 203, package 207, and carrier 205, and like or similar features are designated with like or similar reference numerals.

As shown in FIG. 9, the attachment panel 217 can be provided with container retention openings 223A that have a generally circular configuration as opposed to the peanut-shaped container retention openings 223 as described above. Each container retention opening 223A can include container retention edges 225A, 227A, with respective oblique or tapered cutouts 229A provided therebetween, e.g., so as to be intersecting/abutting respective endpoints thereof.

As shown, the container retention openings 223A can have flexible features, e.g., oblique or tapered cutouts or other discontinuities along respective thereof, to permit flexible reconfiguration of the attachment panel 217 to at least partially receive containers C through the respective openings 223A in a manner similar to that described above with regard to the container retention openings 223.

The blank 203A can also include handle features for forming handle features of the carrier 205 and package 207. The handle features can include finger flaps or handle flaps 239A separably connected to the attachment panel 217 at respective cuts 241A having one or more of straight, curved, and/or angled portions.

The blank 203A can include a first top end flap or first top panel 219 foldably connected to the attachment panel at a lateral fold line 221. As shown, container retention tabs 233A can be separably connected to the first top end flap 219 at respective lines of weakening 243A having one or more straight, curved, and/or angled portions. The lines of weakening 243A can be positioned opposite a free container retention tab edge 237A of the respective container retention tabs 237A such that the lines of weakening 243A and free edges of the container retention tabs 233A form the container retention tab edges 237A of the respective container retention tabs 237A.

Handle features of the blank 203A/carrier 205A/package 205A can also include finger flaps or handle flaps 245A separably connected to the top panel 219 at respective cuts 247A having one or more of straight, curved, and/or angled portions.

The blank 203A can also include a second top end flap or second top panel 249A foldably connected to the attachment panel 217 at a lateral fold line 251B. The second top panel 249A can generally be a mirror image of the first top panel 219, e.g., so as to have the container retention tabs 233A and associated features and the handle flaps 245A and associated features.

In order to form the carrier 205A and package 207A from the blank 203A according to one exemplary embodiment of the disclosure, the blank 203A can be inverted, e.g., with the exterior surface 201 facing downwardly, and can be positioned on top of the group of containers C and the attachment panel 217 of the blank 203 can be pushed downward so that the flanges F of the containers are inserted through a respective opening 223A.

Thereafter, the top panel 219 can be folded at the fold line 221 into at least partial face-to-face contact with upper edges of the containers C so as to be in generally parallel and spaced relation to the attachment panel 217 therebelow.

The top panel 249A can also be folded at the fold line 251A into overlapping relation with the top panel 219 such that the top panels 219, 249A are in at least partial face-to-face contact. It will be understood that the sequence of folding steps described above can be reversed, e.g., such that the top panel 219 is positioned in overlapping and at least partial face-to-face contact with the top panel 251A, without departing from the disclosure.

In the aforementioned arrangement, the container retention tabs 233A associated with the top panel 219 and the container retention tabs 233A associated with the top panel 249A can be generally aligned and positioned above the attachment panel 217 between respective longitudinally adjacent containers C of the plurality of containers C.

In this regard, in order to activate the container retention tabs 233A, the container retention tabs 233A can be separated from the top panel 249A at the respective lines of weakening 243A and the container retention tabs 233A therebelow can be separated from the top panel 219 at the respective lines of weakening 243A.

In such an arrangement, the container retention tabs 233A can be generally aligned between the necks N of longitudinally adjacent containers C protruding through the container retention openings 223A in the attachment panel 217. This positioning of the container retention tabs 233A is such that the container retention tab edges 237A face the respective necks N of the respective containers C to press the respective containers C outwardly away from the lateral axis L2, e.g., to urge the respective necks N of the containers C into a tighter/more secure engagement with the respective retention edges 225A, 227A. Accordingly, the container retention tabs 233A can be positioned in at least partial face-to-face contact with the attachment panel 217.

In some embodiments, the container retention tabs 233A can be partially separated from the top panels 219, 249A at the respective lines of weakening 243A, e.g., such that one or more portions of the respective container retention tab 223A remains attached to the respective top panels 219, 249A with one or more central portions of the respective container retention tabs 223A flexing, bowing, curving, etc., downwardly to position the container retention tab edges 237A facing the respective necks N of the respective containers C as described above. In other embodiments, the container retention tabs 223A can be fully separated from the top panels 219, 249A so as to be positioned between the necks N of respective containers C as described above.

In this regard, upon formation of a package 207A and carrier 205A from the blank 203A, the container retention tabs 223A can be overlapped to form a two-ply reinforcing structure between respective adjacent containers C to provide and enhance the advantages described above with regard to the blanks 103, 103A, 103B, 203/carriers 105, 105A, 105B, 205/packages 107, 107A, 107B, 207. Furthermore, the positioning of the predominantly uninterrupted top panels 219, 249A over the attachment panel 217 can provide a uniform or clean appearance that is appealing to a customer. Furthermore, such overlap of the top panels 219, 249A over the majority of the containers C can inhibit, minimize, prevent, and/or otherwise avoid debris or other incidental materials from contacting the upper portions of the containers C.

The blanks according to the present disclosure can be, for example, formed from coated paperboard and similar materials. For instance, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the disclosure, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

an attachment panel having a plurality of container retention openings for at least partially receiving respective containers of the plurality of containers, at least one container retention opening is defined by a first container retention edge and a second container retention edge; and container retention features comprising the plurality of container retention openings and at least one container retention tab in at least partial face-to-face contact with the attachment panel and for being positioned between adjacent containers of the plurality of containers to urge the plurality of containers into engagement with the attachment panel, the at least one container retention tab is attached to the attachment panel and comprises a central portion and at least one extension, the at least one extension extending from the attachment panel to the central portion and positioned interrupting the first container retention edge and the second container retention edge.

2. The carrier of claim 1, wherein the central portion of the at least one container retention tab comprises a first curved container retention tab edge for engaging a respective first container of the plurality of containers and a second curved container retention tab edge for engaging a respective second container of the plurality of containers.

3. The carrier of claim 2, wherein a portion of the central portion is positioned in at least partial face-to-face contact with a portion of the at least one extension.

4. The carrier of claim 1, wherein the at least one container retention tab is a first container retention tab attached to the attachment panel, the container retention features further comprise a second container retention tab attached to the attachment panel, the first container retention tab positioned in at least partial face-to-face contact with the second container retention tab.

5. The carrier of claim 1, wherein the central portion comprises a first portion separably connected to a second portion at a cut.

6. The carrier of claim 5, wherein the first portion of the central portion of the at least one container retention tab defines a first container retention tab edge for engaging a respective container of the plurality of containers and the second portion of the central portion of the at least one container retention tab defines a second container retention tab edge for engaging the respective container of the plurality of containers.

7. A blank for forming a carrier for holding a plurality of containers, the blank comprising:

an attachment panel having a plurality of container retention openings for at least partially receiving respective containers of the plurality of containers, at least one container retention opening is defined by a first container retention edge and a second container retention edge; and container retention features comprising the plurality of container retention openings and at least one container retention tab for being positioned in at least partial face-to-face contact with the attachment panel and for being positioned between adjacent containers of the plurality of containers when the carrier is formed from the blank to urge the plurality of containers into engagement with the attachment panel, the at least one container retention tab is attached to the attachment panel and comprises a central portion and at least one extension, the at least one extension extending from the attachment panel to the central portion and positioned interrupting the first container retention edge and the second container retention edge.

8. The blank of claim 7, wherein the central portion of the at least one container retention tab comprises a first curved container retention tab edge for engaging a respective first container of the plurality of containers and a second curved container retention tab edge for engaging a respective second container of the plurality of containers.

9. The blank of claim 7, wherein the at least one container retention tab is a first container retention tab attached to the attachment panel, the container retention features further comprise a second container retention tab attached to the attachment panel, the first container retention tab for being positioned in at least partial face-to-face contact with the second container retention tab when the carrier is formed from the blank.

10. The blank of claim 7, wherein the central portion comprises a first portion separably connected to a second portion at a cut.

11. The blank of claim 10, wherein the first portion of the central portion of the at least one container retention tab defines a first container retention tab edge for engaging a respective container of the plurality of containers and the second portion of the central portion of the at least one container retention tab defines a second container retention tab edge for engaging the respective container of the plurality of containers.

12. A method of forming a carrier for holding a plurality of containers, the method comprising:

obtaining a blank comprising an attachment panel having a plurality of container retention openings for at least partially receiving respective containers of the plurality of containers, and container retention features comprising the plurality of container retention openings and at least one container retention tab, at least one container retention opening is defined by a first container retention edge and a second container retention edge, the at least one container retention tab is attached to the attachment panel and comprises a central portion and at least one extension, the at least one extension extending from the attachment panel to the central portion and positioned interrupting the first container retention edge and the second container retention edge;

positioning the attachment panel with the plurality of container retention openings positioned to at least partially receive a respective container of the plurality of containers; and positioning the at least one container retention tab in at least partial face-to-face contact with the attachment panel for being positioned between adjacent containers of the plurality of containers to urge the plurality of containers into engagement with the attachment panel.

13. The method of claim 12, wherein the central portion of the at least one container retention tab comprises a first curved container retention tab edge for engaging a respective first container of the plurality of containers and a second curved container retention tab edge for engaging a respective second container of the plurality of containers.

14. The method of claim 13, further comprising positioning a portion of the central portion in at least partial face-to-face contact with a portion of the at least one extension.

15. The method of claim 12, wherein the at least one container retention tab is a first container retention tab attached to the attachment panel, the container retention features further comprise a second container retention tab attached to the attachment panel, the method comprising positioning the first container retention tab in at least partial face-to-face contact with the second container retention tab.

16. The method of claim 12, wherein the central portion comprises a first portion separably connected to a second portion at a cut.

17. The method of claim 16, wherein the first portion of the central portion of the at least one container retention tab defines a first container retention tab edge for engaging a respective container of the plurality of containers and the second portion of the central portion of the at least one container retention tab defines a second container retention tab edge for engaging the respective container of the plurality of containers.

18. A package, the package comprising:

a plurality of containers; and a carrier holding the plurality of containers, the carrier comprising:

an attachment panel having a plurality of container retention openings at least partially receiving respective containers of the plurality of containers, at least one container retention opening is defined by a first container retention edge and a second container retention edge; and container retention features comprising the plurality of container retention openings and at least one container retention tab in at least partial face-to-face contact with the attachment panel and positioned between adjacent containers of the plurality of containers to urge the plurality of containers into engagement with the attachment panel, the at least one container retention tab is attached to the attachment panel and comprises a central portion and at least one extension, the at least one extension extending from the attachment panel to the central portion and positioned interrupting the first container retention edge and the second container retention edge.

19. The package of claim 18, wherein the central portion of the at least one container retention tab comprises a first curved container retention tab edge engaging a respective first container of the plurality of containers and a second curved container retention tab edge engaging a respective second container of the plurality of containers.

20. The package of claim 19, wherein a portion of the central portion is positioned in at least partial face-to-face contact with a portion of the at least one extension.

21. The package of claim 18, wherein the at least one container retention tab is a first container retention tab attached to the attachment panel, the container retention features further comprise a second container retention tab attached to the attachment panel, the first container retention tab positioned in at least partial face-to-face contact with the second container retention tab.

22. The package of claim 18, wherein the central portion comprises a first portion separably connected to a second portion at a cut.

23. The package of claim 22, wherein the first portion of the central portion of the at least one container retention tab defines a first container retention tab edge engaging a respective container of the plurality of containers and the second portion of the central portion of the at least one container retention tab defines a second container retention tab edge engaging the respective container of the plurality of containers.

* * * * *